US011448400B2

(12) United States Patent
Wardrop et al.

(10) Patent No.: US 11,448,400 B2
(45) Date of Patent: Sep. 20, 2022

(54) FIREBOX ASSEMBLY FOR A GAS FIREPLACE AND GAS HEATING APPLIANCE

(71) Applicant: FLEXCHANGER TECHNOLOGIES INC., Vancouver (CA)

(72) Inventors: Walter Wardrop, Vancouver (CA); Nicholas Barber, Mission (CA)

(73) Assignee: Flexchanger Technologies, Inc.

( * ) Notice: Subject to any disclaimer, the term of this patent is extended or adjusted under 35 U.S.C. 154(b) by 0 days.

(21) Appl. No.: 17/613,921

(22) PCT Filed: May 22, 2020

(86) PCT No.: PCT/CA2020/050701
§ 371 (c)(1),
(2) Date: Nov. 23, 2021

(87) PCT Pub. No.: WO2020/237357
PCT Pub. Date: Dec. 3, 2020

(65) Prior Publication Data

US 2022/0221153 A1 Jul. 14, 2022

(30) Foreign Application Priority Data

May 24, 2019 (CA) ..... CA 3044470

(51) Int. Cl.
*F24C 15/32* (2006.01)
*F24C 15/00* (2006.01)
(Continued)

(52) U.S. Cl.
CPC ..... *F24C 3/004* (2013.01); *F24C 15/002* (2013.01); *F24C 15/004* (2013.01); *F24C 15/322* (2013.01); *F24H 3/025* (2013.01)

(58) Field of Classification Search
CPC ..... F24C 3/004; F24C 15/002; F24H 3/025; F24B 13/02
See application file for complete search history.

(56) References Cited

U.S. PATENT DOCUMENTS 4,137,896 A 2/1979 Edwards
4,266,526 A * 5/1981 Tolotti ..... F24B 1/1806 126/502
(Continued)

FOREIGN PATENT DOCUMENTS

CA 2146909 A * 10/1995 ..... F24B 1/1808
CA 2847493 A1 * 9/2014 ..... F24B 1/189
(Continued)

OTHER PUBLICATIONS

International Search Report issued in PCT/CA2020050701 dated Jul. 16, 2020. 3 pages.
(Continued)

*Primary Examiner* — Jorge A Pereiro
(74) *Attorney, Agent, or Firm* — Baumgartner Patent Law; Marc Baumgartner

(57) ABSTRACT

A firebox is provided for use in a gas fireplace, the firebox comprising: a back which includes at least one combustion fan aperture, an upper end and a lower end and a length therebetween, a pair of sides, each side including an upper end, a lower end, a first riser which has an inner section and an outer section, the inner section attached to the back, a first flange, which is parallel to the back and extends outward from the back, and a second riser, wherein the outer section of the first riser, the first flange and the second riser extend above the upper end of the back and below the lower end of the back; a top which is attached to the inner section of the first risers and to the back at the upper end; and a base which is attached to the inner section of the first risers and to the
(Continued)

back above the combustion fan aperture, to define an opening. The fireplace is also provided.

20 Claims, 29 Drawing Sheets

(51) Int. Cl.
*F24C 3/00* (2006.01)
*F24H 3/02* (2022.01)

(56) References Cited

U.S. PATENT DOCUMENTS 4,385,622 A * 5/1983 Tidwell ..... F24B 1/18 126/516
4,519,377 A 5/1985 Taylor
5,167,219 A 12/1992 Ehmke
5,647,342 A * 7/1997 Jamieson ..... F24C 3/004 126/531
5,782,231 A * 7/1998 Wade ..... F24B 1/1808 126/200
5,901,701 A * 5/1999 Wade ..... F24B 1/18 126/529
6,138,667 A 10/2000 Cakebread
6,439,226 B1 8/2002 Johnson
6,910,477 B1 * 6/2005 Barber ..... F24C 15/002 126/503
2015/0219339 A1 8/2015 Maxson
2015/0276227 A1 * 10/2015 Marcakis ..... F24B 13/02 126/518
2017/0159940 A1 6/2017 Little

FOREIGN PATENT DOCUMENTS

EP 3261407 A1 * 12/2017 ..... F24C 7/043
GB 2412165 A * 9/2005 ..... F24C 15/06
WO WO-2019213731 A1 * 11/2019 ..... A47J 37/0759

OTHER PUBLICATIONS

Written Opinion of the International Searching Authority issued in PCT/CA2020050701 dated Jul. 16, 2020. 5 pages.
International Preliminary Examination Report issued in PCT/CA2020050701 dated Apr. 7, 2021. 3 pages.

* cited by examiner

FIREBOX ASSEMBLY FOR A GAS FIREPLACE AND GAS HEATING APPLIANCE

CROSS REFERENCE TO RELATED APPLICATIONS

This application is a U.S. national phase of International Application No. PCT/CA2020/050701, filed May 22, 2020, which claims priority to Canadian Patent Application Serial No. 3044470, filed 24 May 2019, both entitled FIREBOX ASSEMBLY FOR A GAS FIREPLACE AND GAS HEATING APPLIANCE. The above-identified priority patent applications are incorporated herein by reference in their entirety.

FIELD

The present technology is an easy to assemble firebox assembly and fireplace. More specifically, it is a firebox which includes an angled channel for accepting the front glass and a firebox assembly that has significantly fewer parts, both resulting in lower tooling, inventory and assembly costs.

BACKGROUND

There are many designs for gas and propane fireplaces and stoves. These designs originated from wood burning, glass front fireplaces and stoves. While there has been a focus on aesthetics and efficiency, it is clear that ease of manufacturing and manufacturing costs have not been a high priority, nor has safety over a hot glass front.

For example, U.S. Pat. No. 6,439,226 discloses a front surround or enclosure for overlying the open front of a fireplace box. The enclosure has a relatively narrow peripheral frame that carries one or a plurality of glass panels that substantially fill the enclosed area defined by the outer frame. The glass panels may be rigidly secured to the frame or can be configured as operable doors. Patterns configured by silk screening or other application techniques are selectively applied, preferably to the inner surface(s), of the glass panel(s) to enhance visual appeal of the glass and/or to selectively mask the viewer's vision through the glass. Quick release brackets are provided for detachably securing the enclosure to the front of a fireplace box. This does not address the safety concern over a hot glass front, nor does it address efficient manufacturing.

U.S. Pat. No. 6,138,667 discloses a gas fueled direct vent fireplace that has a firebox within an outer casing, the firebox having a mounting plate above the floor of the casing for mounting burner support brackets, a pilot light assembly, a gas valve and control assembly, and other conventional elements for controlling the burner. The firebox has a frontal opening which is closed by a glass access door having an extrusion at upper and lower edges and side edge protectors. The extrusions have portions which face the interior of the firebox to be grasped by latches mounted on the firebox to tightly secure the glass access door to the firebox. A gasket is bonded to the surface of the glass which faces the firebox and seals the glass against the firebox. This provides a single pane of glass, thus does not provide a safety barrier, nor does it address efficient manufacturing.

U.S. Pat. No. 5,167,219 discloses a frame assembly (10) for a fireplace opening (12) comprising a frame member (24) and a clip (26). The frame member (24) includes segments (28, 30, 32, and 34) of discrete length that are fitted to sidewall portions (14, 16, 18, and 20) of the fireplace opening (12). The frame member (24) has semicircular channel (46) and an access opening (48) to the channel that are directed longitudinally along the length of the frame member (24). The clip (26) includes a lip (72) that is sized to be received within the semicircular channel (46) of the frame member (24), the clip (26) being slidable or otherwise positionable at desired locations along the length of any of the segments (28, 30, 32, and 34). The clip (26) extends outwardly from the frame member (24) for attachment to the sidewall portions (14, 16, 18, and 20) of the fireplace opening (12) by a fastener (90) that extends through an aperture (76) in the clip (26). This frame assembly has multiple parts that must be stocked and assembled, thus increasing the number of steps required in manufacturing and increasing the chance of human error. The glass is permanently affixed to the frame. Further, there is only a single pane of glass, hence the glass front could become dangerously hot.

U.S. Pat. No. 4,519,377 discloses a fireplace heat transfer apparatus that includes a main inner panel assembly adapted to be positioned across any opening to a fireplace and an auxiliary outer panel assembly pivotally mounted to the main assembly. The main assembly includes an inner transparent plate of glass and the auxiliary assembly includes an outer transparent plate of glass. The outer glass plate is thicker than the inner glass plate. The mounting relationship of the auxiliary frame to the main frame maintains the outer plate of glass in a spaced relationship to the inner plate of glass so as to define a heat transfer chamber between them. The auxiliary and main assemblies have respective frame structures which closes the chamber at its sides but provides the chamber with an open top and bottom for communicating the chamber with ambient air in the room surrounding the fireplace. By pivoting the auxiliary assembly about an axis defined across its lower end and relative to the main assembly the volume of the chamber may be changed in order to change the rate of convective thermosiphon flow of heated ambient air up through the chamber. This frame assembly has multiple parts that must be stocked and assembled, thus increasing the number of steps required in manufacturing and increasing the chance of human error. The glass panes are permanently affixed to the frame.

U.S. Pat. No. 4,137,896 discloses a combination fireplace enclosure and heat-exchanger unit for providing supplemental heat to areas external to the fireplace. The unit includes an enclosure frame having double-paned glass closure doors, and a steam-heating system disposed at the upper portion of the frame. The heating system comprises a boiler device mounted at the rear of the frame and above the fire, and a heat-exchanger device disposed at the front of the frame. The heat-exchanger device has a steam passage which is connected by a steam line to the boiler. The passage is sloped with respect to the horizontal, such that condensate from the exchanger device can flow by gravity back to the boiler device to be converted into steam. The entire system is vented to the atmosphere whereby there is no danger of pressure build-up; accordingly the need for relief valves is obviated. Means providing an inlet to the system enable measured quantities of water to be added periodically, as required. The enclosure and heat-exchanger unit are completely self-contained, and accordingly can be readily installed with a minimum of tools, and with no external plumbing connections being required. This frame assembly has multiple parts that must be stocked and assembled, thus increasing the number of steps required in manufacturing and increasing the chance of human error. The glass panes are permanently affixed and do not allow for convective air flow between them.

United States Patent Application 20170159940 discloses a fireplace system that can comprise a first safety barrier and a second safety barrier disposed across a firebox opening and defining an interbarrier space. A fireplace system can also comprise a heat exchanger in fluid communication with the interbarrier space. The interbarrier space and heat exchanger may further be in fluid communication with ambient air. Operation of the fireplace system may produce natural convection through the interbarrier space, resulting in cooling of the safety barrier and the fireplace system. The framework for retaining the glass panels has numerous parts that must be stocked and assembled, thus increasing the number of steps required in manufacturing and increasing the chance of human error. The glass panes are permanently affixed in the frames.

United States Patent Application 20150219339 discloses a shield for spaced placement away from and over a fireplace glass plate. During operation of the fireplace, the fireplace glass plate becomes dangerously hot. As the glass plate heats, a pressure gradient is gradually established. Through this mechanism, cooler ambient room air is passively drawn into, through and out of, the spacing between the fireplace glass plate and the shield. The shield remains at a safe temperature to the touch and the ambient temperature of the room is increased. The present invention thus reduces contact burn injuries as well as providing an additional passive heat circulation engine. The shield is an additional component to be added to an existing fireplace. The glass pane is permanently affixed to the spacing brackets.

What is needed is a firebox and fireplace that is assembled from substantially fewer parts than are currently used. It would be preferable if the parts were designed such that their assembly is intuitive, thus reducing the chance of human error. It would also be preferable it there was not a multitude of small parts that can easily be lost, are difficult to understand their placement, and increase the number of steps required in assembly. It would be of further advantage if the glass panes could be easily removed and replaced if damaged. It would be of further advantage if the resulting assembly was of high heat exchange efficiency. It would be of further advantage if the glass panes could be assembled to provide a cooled glass front, thereby reducing the chance of the heat causing damage or injury.

SUMMARY

The present technology is a firebox and fireplace that is assembled from substantially fewer parts than are currently used. The parts have been designed such that their assembly is intuitive, thus reducing the chance of human error. There are few small parts that can easily be lost, are difficult to understand their placement, and increase the number of steps required in assembly. The glass panes can be easily removed and replaced if damaged. The resulting assembly has high heat exchange efficiency, in part because of fins that extend into the combustion chamber and the airbox. The glass panes are assembled to provide a cooled glass front, thereby reducing the chance of the heat causing damage or injury.

In one embodiment, a firebox for a gas fireplace is provided, the firebox comprising: a back which includes at least one combustion fan aperture, an upper end and a lower end and a length therebetween, a pair of sides, each side including an upper end, a lower end, a first riser which has an inner section and an outer section, the inner section attached to the back, a first flange, which is parallel to the back and extends outward from the back, and a second riser, wherein the outer section of the first riser, the first flange and the second riser extend above the upper end of the back and below the lower end of the back; a top which is attached to the inner section of the first risers and to the back at the upper end; and a base which is attached to the inner section of the first risers and to the back above the combustion fan aperture, to define an opening.

In the firebox, the back and the sides may include a plurality of fins extending outward from the back and inward from the back towards the opening.

In the firebox, the back, the sides and the fins may be a single extrusion.

In the firebox, the back may include a right side section, a left side section and a middle section.

The firebox may further comprise a plurality of risers, a plurality of flanges, a plurality of upper channel members and a plurality of lower channel members, the upper channel of a selected upper channel member and the lower channel of a selected lower channel member aligned with a selected pair of flanges or a selected pair of risers.

The sides may each further comprise a second flange, which is parallel to the back, sits on the second riser and extends outward from the back; and a third riser, wherein the second flange and the third riser extend above the upper end of the back and below the lower end of the back.

In another embodiment, a firebox assembly for a gas fireplace is provided, the firebox assembly comprising: a firebox, the firebox including a back which includes at least one combustion fan aperture, an upper end and a lower end and a length therebetween, a pair of sides, each side including an upper end, a lower end, a first riser which has an inner section and an outer section, the inner section attached to the back, a first flange, which is parallel to the back and extends outward from the back, and a second riser, wherein the outer section of the first riser, the first flange and the second riser extend above the upper end of the back and below the lower end of the back, a top which is attached to the inner section of the first risers and to the back at the upper end, and a base which is attached to the inner section of the first risers and to the back above the combustion fan aperture, to define an opening; a innermost glass pane mounted over the opening and seated on the first flanges, the top and the base, the innermost glass pane, top, base, sides and back defining a combustion chamber; a frame mounted on the innermost glass pane and seated above the first flanges, the top and the base to provide an airtight seal; a first glass upper channel member attached to the upper end of each side at the first risers and the first flanges, the first glass upper channel member including a first glass upper channel including a channel back, a channel top and a channel front, the channel back and the channel front defining a mouth, the channel back angled from the mouth towards the back, the mouth disposed in front of the first flange; a first lower channel member attached to the base, the first lower channel member including a first lower channel; and a second glass pane releasably mounted in the first glass upper channel and the first lower channel and seated on the second risers.

In the firebox assembly, the back and the sides may include a plurality of fins extending outward from the back and inward from the back into the combustion chamber.

In the firebox assembly, the back, the sides and the fins may be a single extrusion.

In the firebox assembly, the back may include a right side section, a left side section and these may join or be separated by one or more middle sections.

The firebox assembly may further comprise a plurality of risers and a plurality of flanges on each side, a plurality of panes of glass, a plurality of upper channel members and a plurality of lower channel members, each pane of glass seated on a selected flange or a selected riser and releasably retained by the upper channel of a selected upper channel member and the lower channel of a selected lower channel member, the upper channel of the selected upper channel member and the lower channel of the selected lower channel member aligned with the selected flange or the selected riser.

The firebox assembly may further comprise: a second flange on each side, which are parallel to the back, are attached to the second riser and extend outward from the back; a third riser on each side, wherein the second flanges and the third risers extend above the upper end of the back and below the lower end of the back; a second upper channel member attached to the sides and located above the first glass upper channel member, the second upper channel member including a second upper channel which includes a channel back, a channel top and a channel front, the channel back and the channel front defining a mouth, the channel back angled from the mouth towards the back, the mouth disposed in front of the second flanges and the mouth of the middle glass upper channel member; a second lower channel member attached to the sides and located below the first lower channel member, the second lower channel member including a second lower channel which is disposed in front of the first lower channel; and a third glass pane releasably mounted in the second upper channel and the second lower channel and seated on the third risers.

The firebox assembly may further comprise an airbox assembly, the airbox assembly including a top, a bottom, sides and a face, the top, the bottom and the sides attached to the back to define an airbox, the face including an exhaust port and an airbox connector aperture, which is aligned with the combustion fan aperture.

In the firebox assembly, the airbox assembly includes an airbox connector, the airbox connector extending between and attached to the airbox face and the back of the firebox for fluid communication between an ambient environment and the combustion fan aperture.

In another embodiment, a combination for use in constructing a gas fireplace is provided, the combination comprising:

a firebox assembly comprising: a firebox, the firebox including a back which includes at least one combustion fan aperture, an upper end and a lower end and a length therebetween, a pair of sides, each side including an upper end, a lower end, a first riser which has an inner section and an outer section, the inner section attached to the back, a first flange, which is parallel to the back and extends outward from the back, and a second riser, wherein the outer section of the first riser, the first flange and the second riser extend above the upper end of the back and below the lower end of the back, a top which is attached to the inner section of the first risers and to the back at the upper end, and a base which is attached to the inner section of the first risers and to the back above the combustion fan aperture, to define an opening; a innermost glass pane mounted over the opening and seated on the first flanges, the top and the base; a frame mounted on the innermost glass pane and seated above the first flanges, the top and the base to provide an airtight seal; a first glass upper channel member attached to the upper end of each side at the first risers and the first flanges, the first glass upper channel member including a first glass upper channel including a channel back, a channel top and a channel front, the channel back and the channel front defining a mouth, the channel back angled from the mouth towards the back, the mouth disposed in front of the first flange; a first lower channel member attached to the base, the first lower channel member including a first lower channel; and a second glass pane releasably mounted in the first glass upper channel and the first lower channel and seated on the second risers;

an outer case comprising: an outer case back including an upper end and a lower end; a pair of sides, each side including an upper end and a lower end; an outer case bottom attached to the outer case back at the lower end and to the sides at the lower end; an outer case top attached to the outer case back at the upper end and to the sides at the upper end, the outer case top including a second upper channel including a channel back, a channel top and a channel front, the channel back and the channel front defining a mouth, the channel back angled from the mouth towards the back, the mouth disposed in front of the second pane of glass;

and a third pane of glass releasably mounted in the second upper channel of the outer case and the second lower channel of the firebox assembly.

In another embodiment, a firebox assembly for a gas fireplace is provided, the firebox assembly comprising: a firebox, the firebox including a back which includes at least one combustion fan aperture, an upper end and a lower end and a length therebetween, a pair of sides, each side including an upper end, a lower end, a riser which has an inner section and an outer section, the inner section attached to the back, a flange, which is parallel to the back and extends outward from the back, a top which is attached to the inner section of the risers and to the back at the upper end, and a base which is attached to the inner section of the risers and to the back above the combustion fan aperture, to define an opening; and a glass pane mounted over the opening and seated on the flanges, the top and the base, the glass pane, top, base, sides and back defining a combustion chamber, wherein the back and the sides include a plurality of fins extending outward from the back and inward from the back into the combustion chamber.

The firebox assembly may further comprise an airbox assembly, the airbox assembly including a top, a bottom, sides and a face, the top, the bottom and the sides attached to the back to define an airbox, the face including an exhaust port and an airbox connector aperture, which is aligned with the combustion fan aperture.

In the firebox assembly, the airbox assembly may include an airbox connector, the airbox connector extending between and attached to the airbox face and the back of the firebox for fluid communication between an ambient environment and the combustion fan aperture.

In the firebox assembly, the back, the sides and the fins may be a single extrusion.

In the firebox assembly, the back may include a right side section, a left side section and these may join or may be separated by one or more middle sections.

FIGURES

FIG. 1 is a perspective view of the fireplace of the present technology.

FIG. 2A is a perspective view of the firebox of the fireplace of FIG. 1; FIG. 2B is a top view of the firebox; FIG. 2C is a side sectional view of the firebox; FIG. 2D is a front view of the firebox; FIG. 2E is an end sectional view of the base and firebox; and FIG. 2F is an end sectional view of the top and the firebox.

Figure 17A:
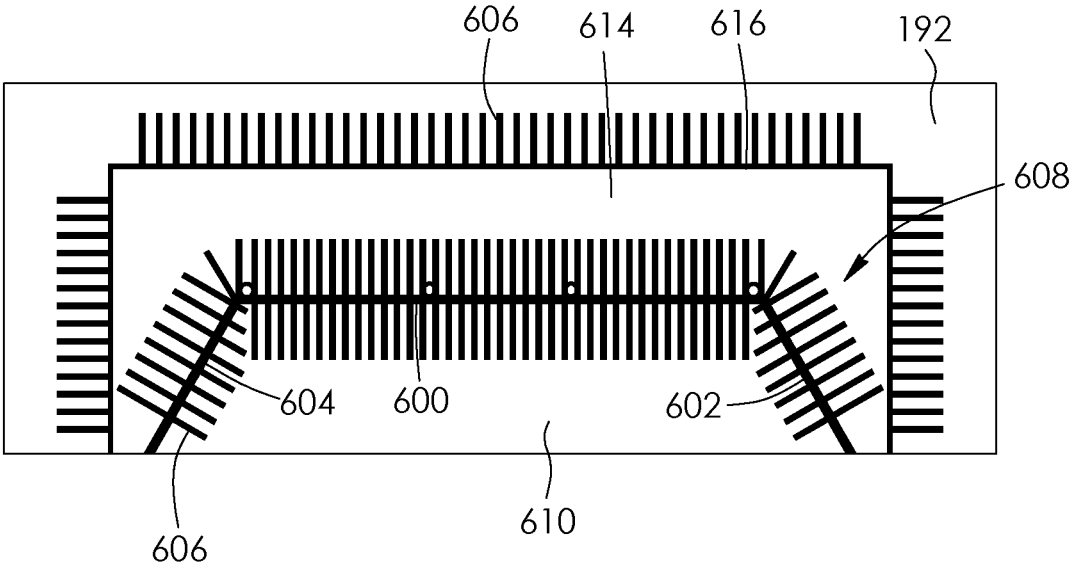
FIG. 17A shows a top sectional view of an alternative embodiment of the fireplace of FIG. 16.
Figure 17B:
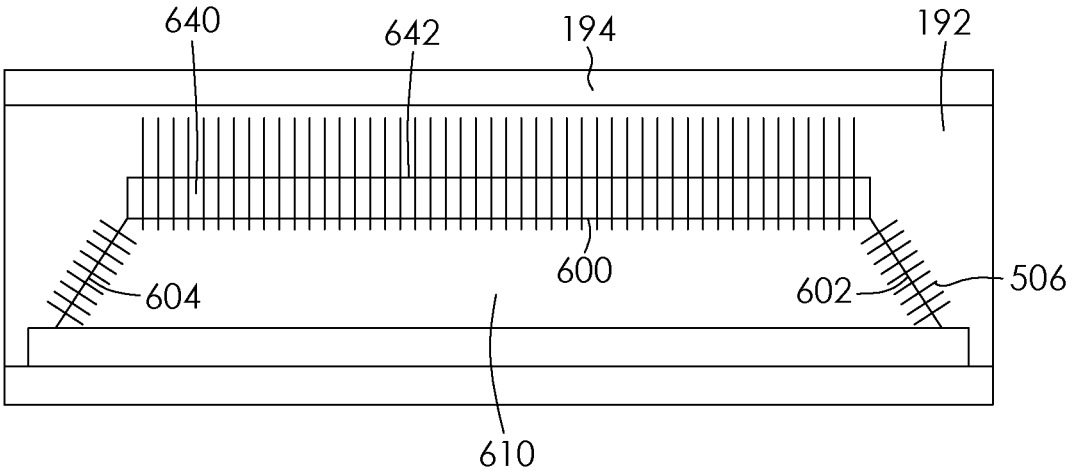
FIG. 17B shows a top sectional view of an alternative embodiment of the fireplace of FIG. 16.
Figure 18A:
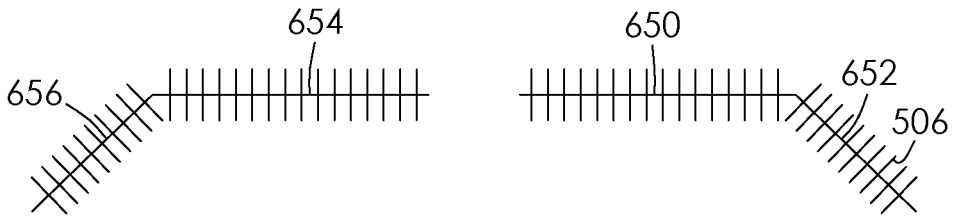
Figure 18B:
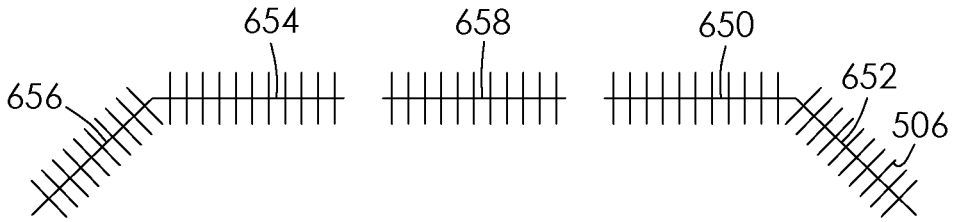
Figure 18C:
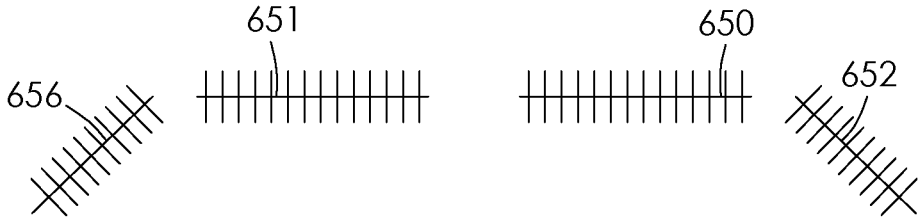

FIG. 18A shows an exploded top sectional view of an alternative embodiment of the firebox of FIGS. 16 and 17; FIG. 18B shows an exploded top sectional view of another alternative embodiment of the firebox of FIGS. 16 and 17; and FIG. 18C shows an exploded top sectional view of another alternative embodiment of the firebox of FIGS. 16 and 17.

Figure 19A:
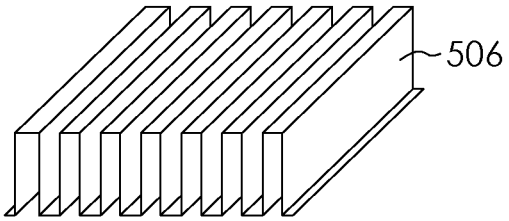
Figure 19B:
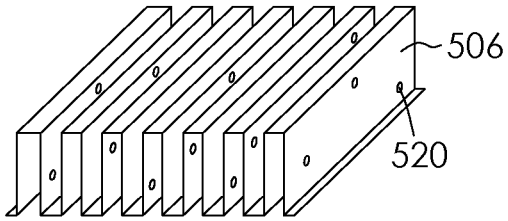
Figure 19C:
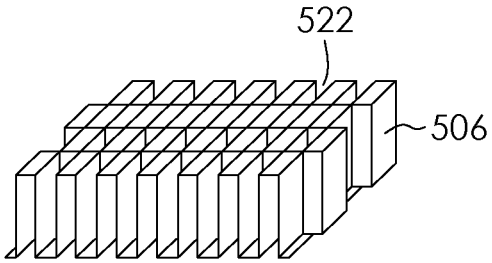
Figure 19D:
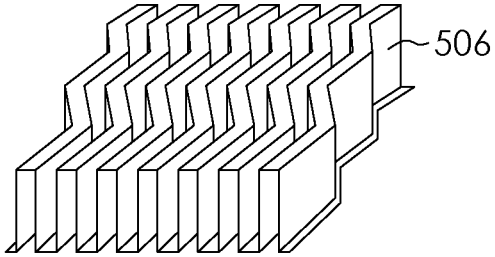
Figure 19E:
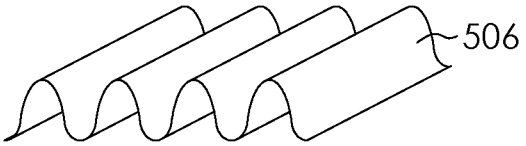
Figure 19F:
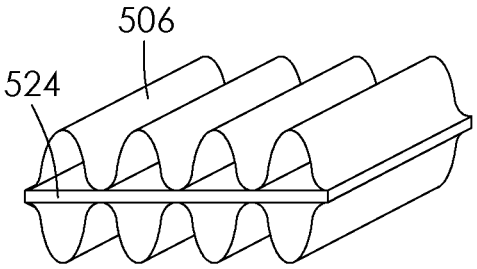
Figure 19G:
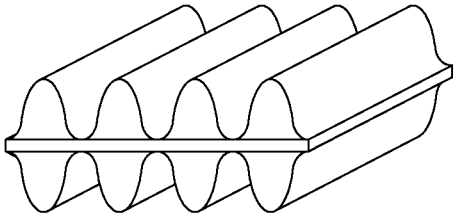

FIG. 19A-G shows perspective views of alternative embodiments to the fins shown in FIGS. 16, 17 and 18. FIG. 19A shows plain box-shaped fins; FIG. 19B shows box-shaped fins with perforations; FIG. 19C shows serrated box-shaped fins; FIG. 19D shows herringbone fins;

FIG. 19E shows wavy fins; FIG. 19F shows double wavy fins; and FIG. 19G shows solid double wavy fins.

DESCRIPTION

Except as otherwise expressly provided, the following rules of interpretation apply to this specification (written description and claims): (a) all words used herein shall be construed to be of such gender or number (singular or plural) as the circumstances require; (b) the singular terms "a", "an", and "the", as used in the specification and the appended claims include plural references unless the context clearly dictates otherwise; (c) the antecedent term "about" applied to a recited range or value denotes an approximation within the deviation in the range or value known or expected in the art from the measurements method; (d) the words "herein", "hereby", "hereof", "hereto", "hereinbefore", and "hereinafter", and words of similar import, refer to this specification in its entirety and not to any particular paragraph, claim or other subdivision, unless otherwise specified; (e) descriptive headings are for convenience only and shall not control or affect the meaning or construction of any part of the specification; and (f) "or" and "any" are not exclusive and "include" and "including" are not limiting. Further, the terms "comprising," "having," "including," and "containing" are to be construed as open-ended terms (i.e., meaning "including, but not limited to,") unless otherwise noted.

Recitation of ranges of values herein are merely intended to serve as a shorthand method of referring individually to each separate value falling within the range, unless otherwise indicated herein, and each separate value is incorporated into the specification as if it were individually recited herein. Where a specific range of values is provided, it is understood that each intervening value, to the tenth of the unit of the lower limit unless the context clearly dictates otherwise, between the upper and lower limit of that range and any other stated or intervening value in that stated range, is included therein. All smaller sub ranges are also included. The upper and lower limits of these smaller ranges are also included therein, subject to any specifically excluded limit in the stated range.

Unless defined otherwise, all technical and scientific terms used herein have the same meaning as commonly understood by one of ordinary skill in the relevant art. Although any methods and materials similar or equivalent to those described herein can also be used, the acceptable methods and materials are now described.

Definitions

Gas—in the context of the present technology, gas, as in a gas fireplace or gas burner includes natural gas, propane and any other gaseous fuel suitable to be burned in a residential fireplace.

DETAILED DESCRIPTION

Figure 1:
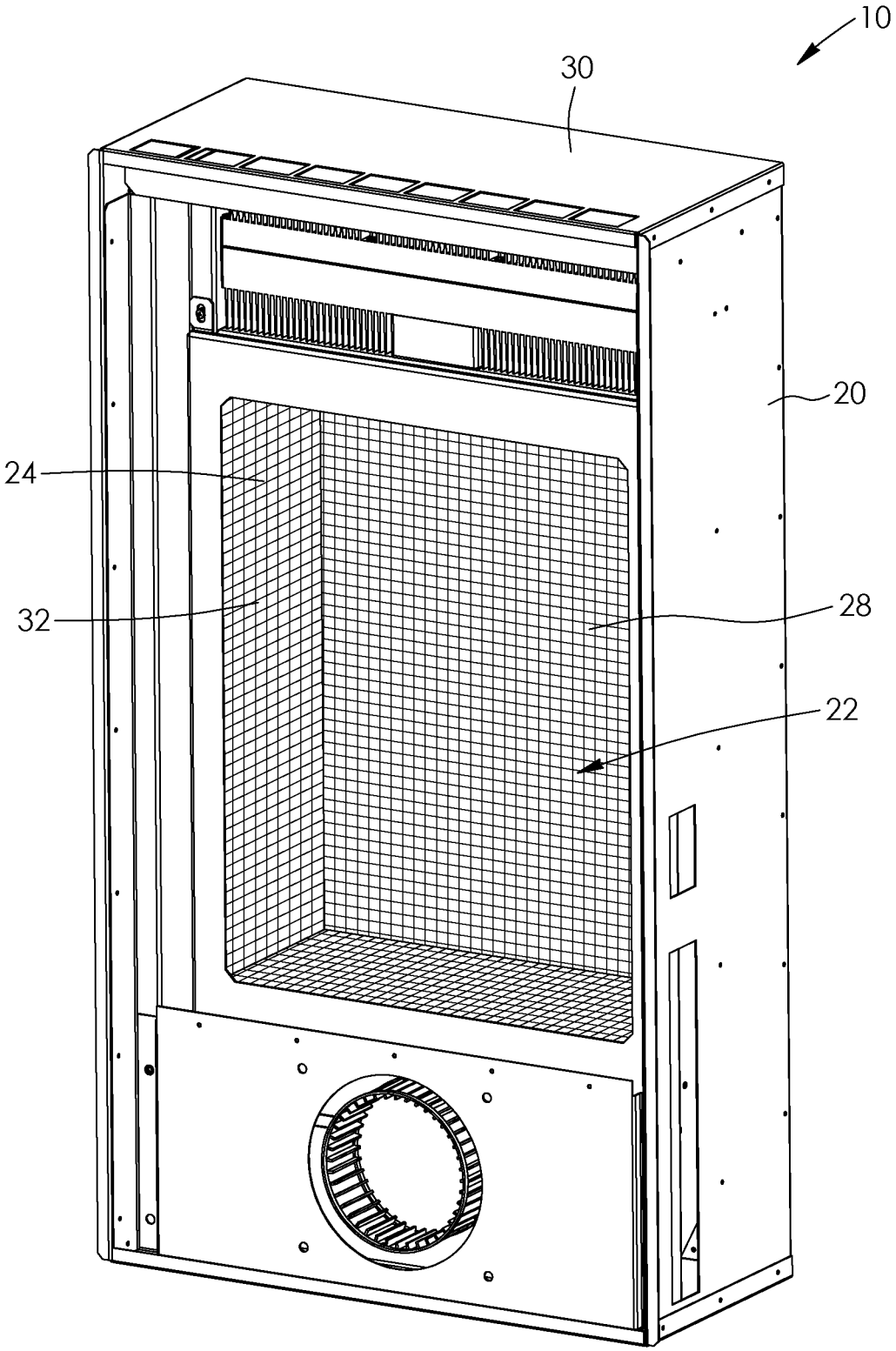

A fireplace, generally referred to as 10 is shown in FIG. 1. It has an outer case 20 and a firebox assembly, generally referred to as 22. During assembly, the firebox assembly 22 is slid into the outer case 20. Decorative panels 24, outer glass pane 28, the outer case top 30 and the firebox 32 can be seen in FIG. 1.

Figure 2A:
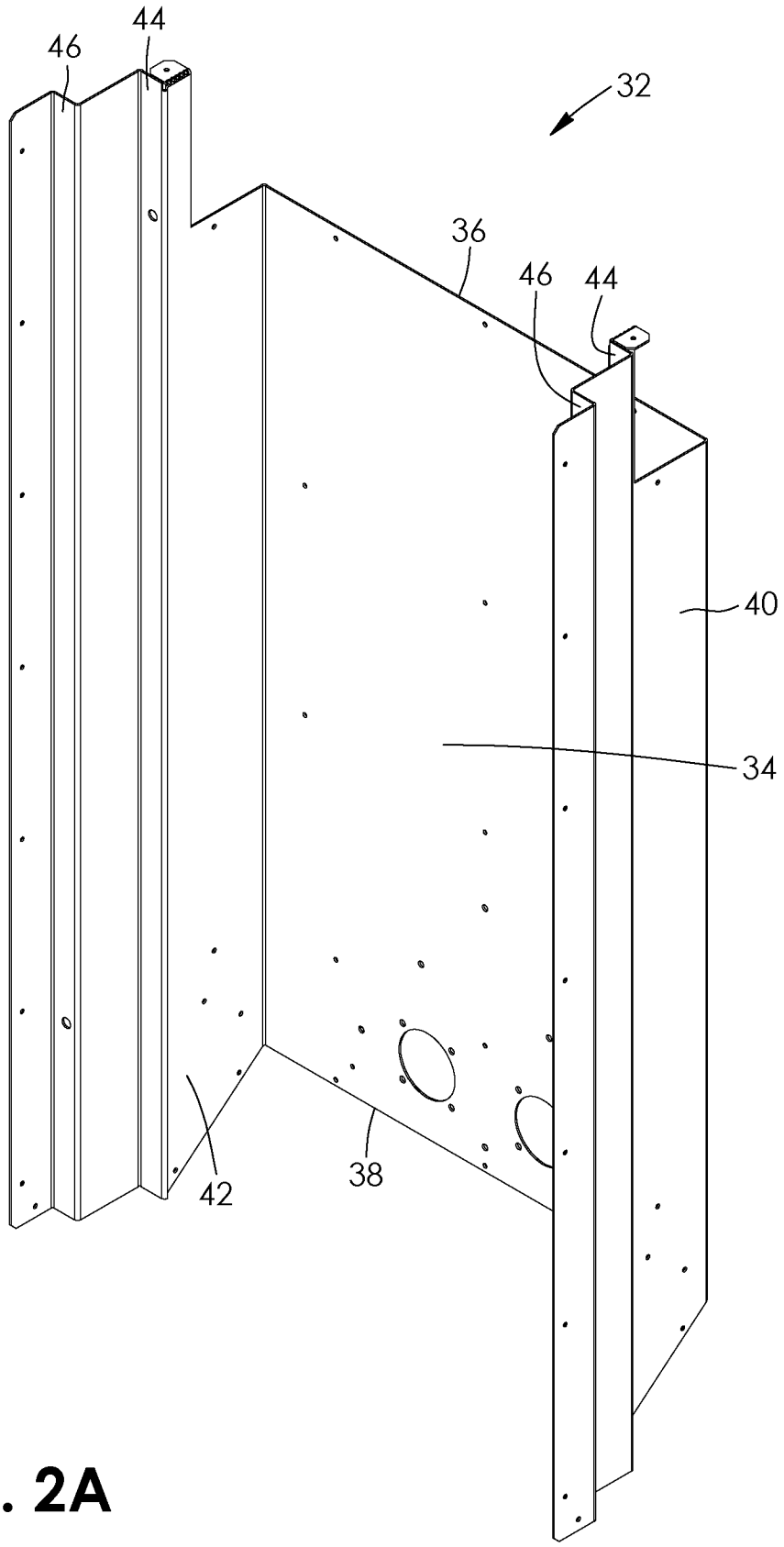
Figure 2B:
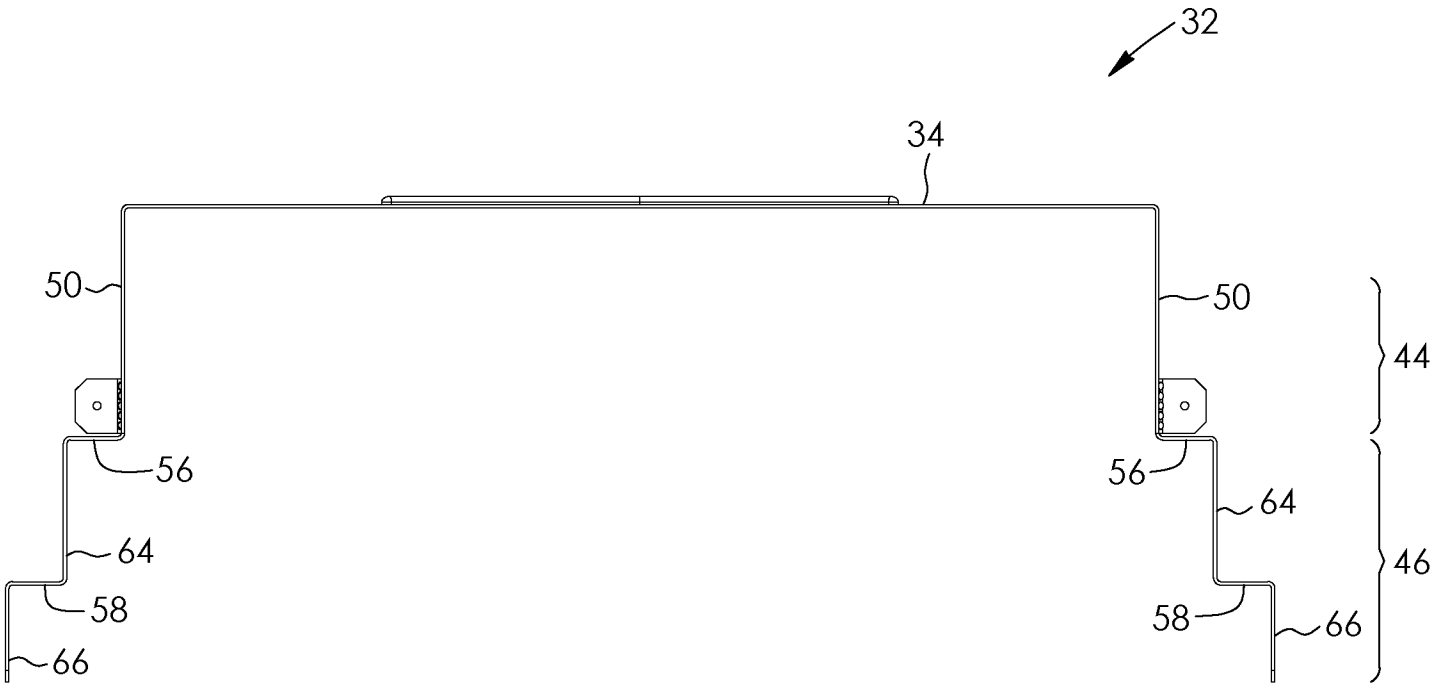
Figure 2C:
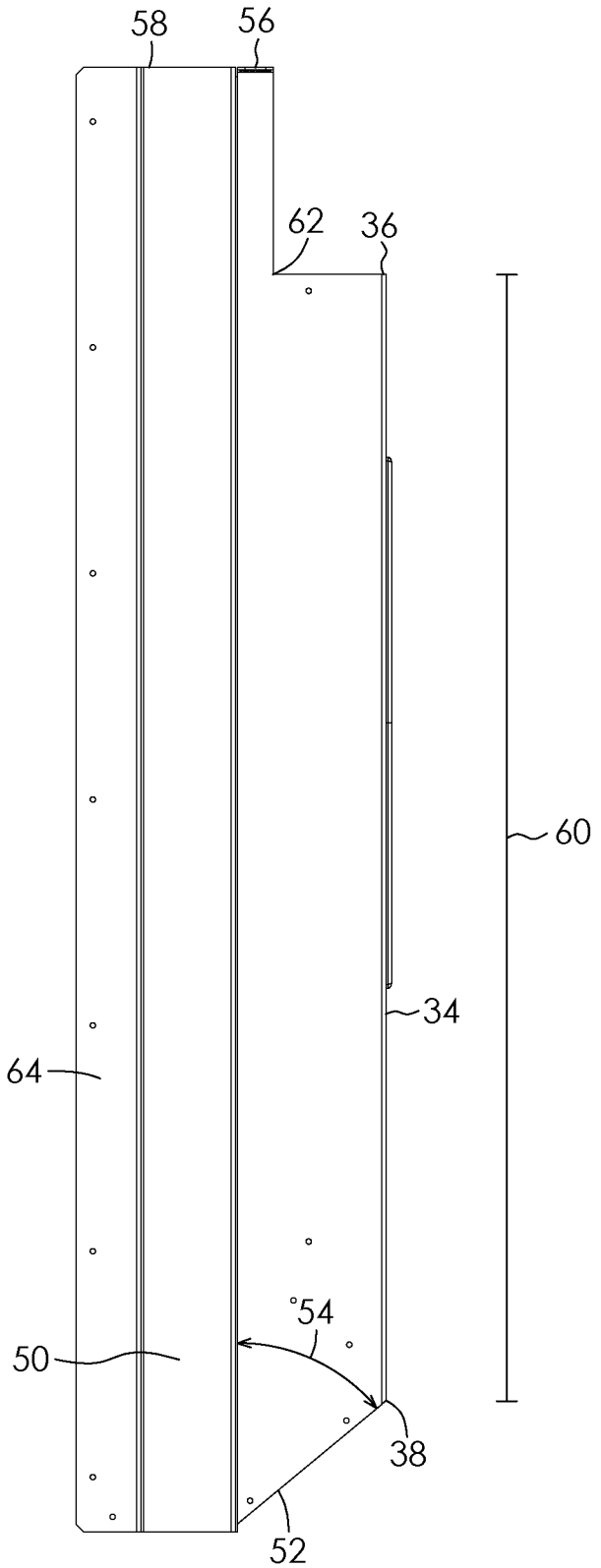
Figure 2D:
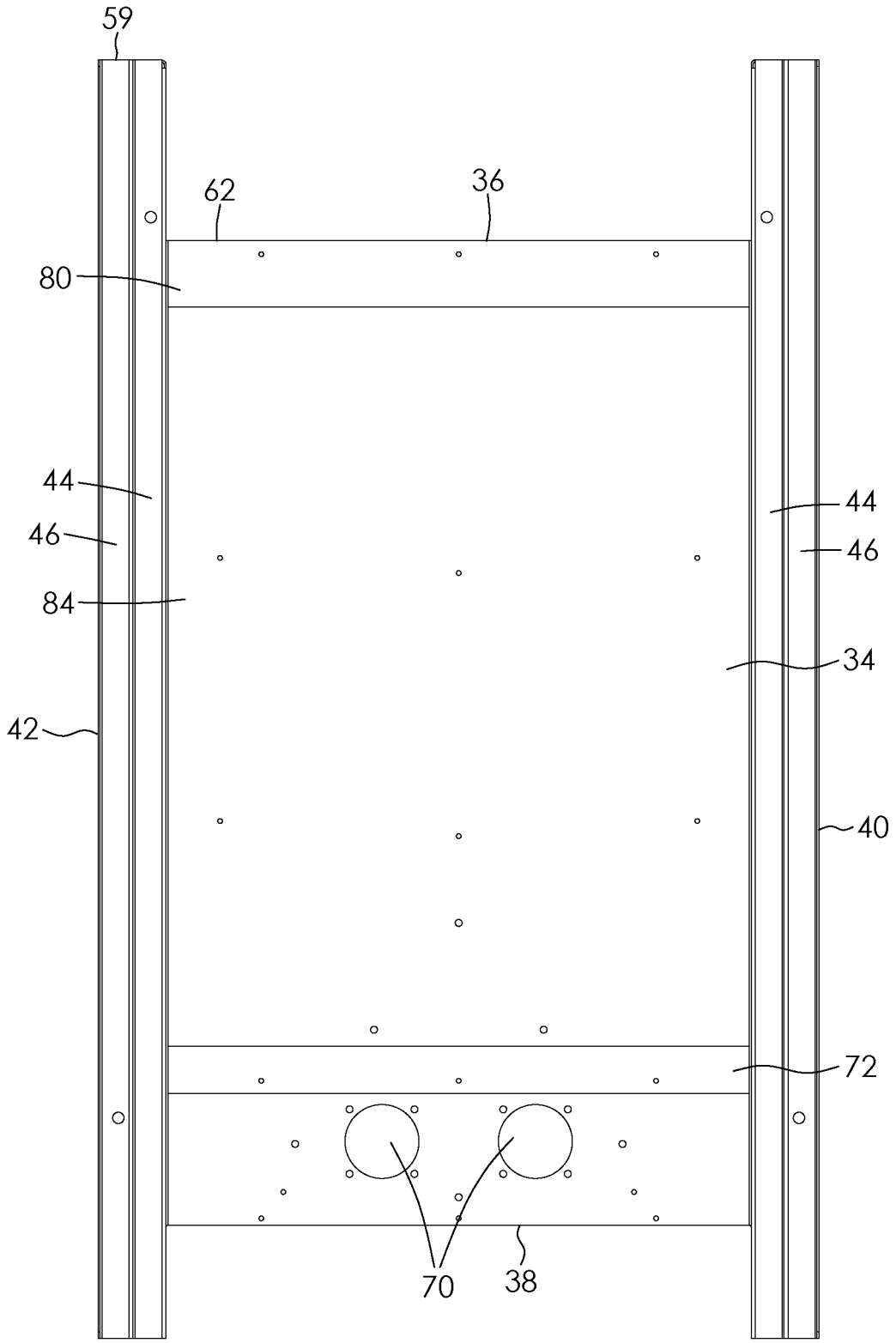
Figure 2E:
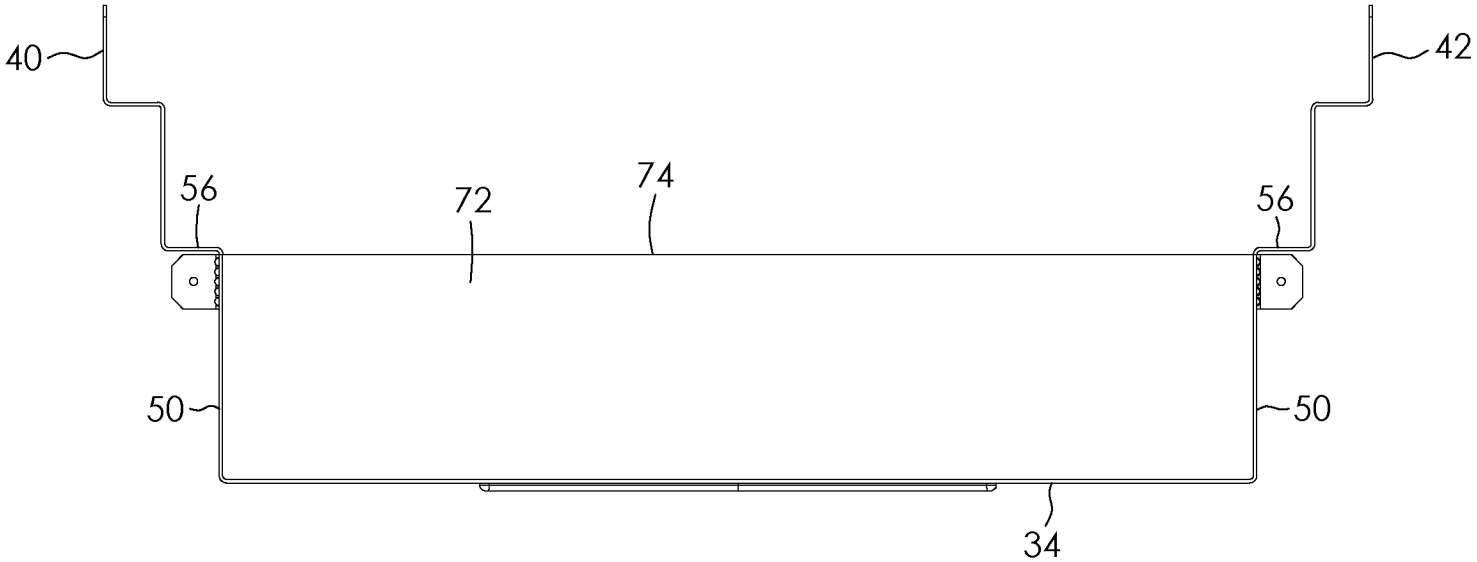
Figure 2F:
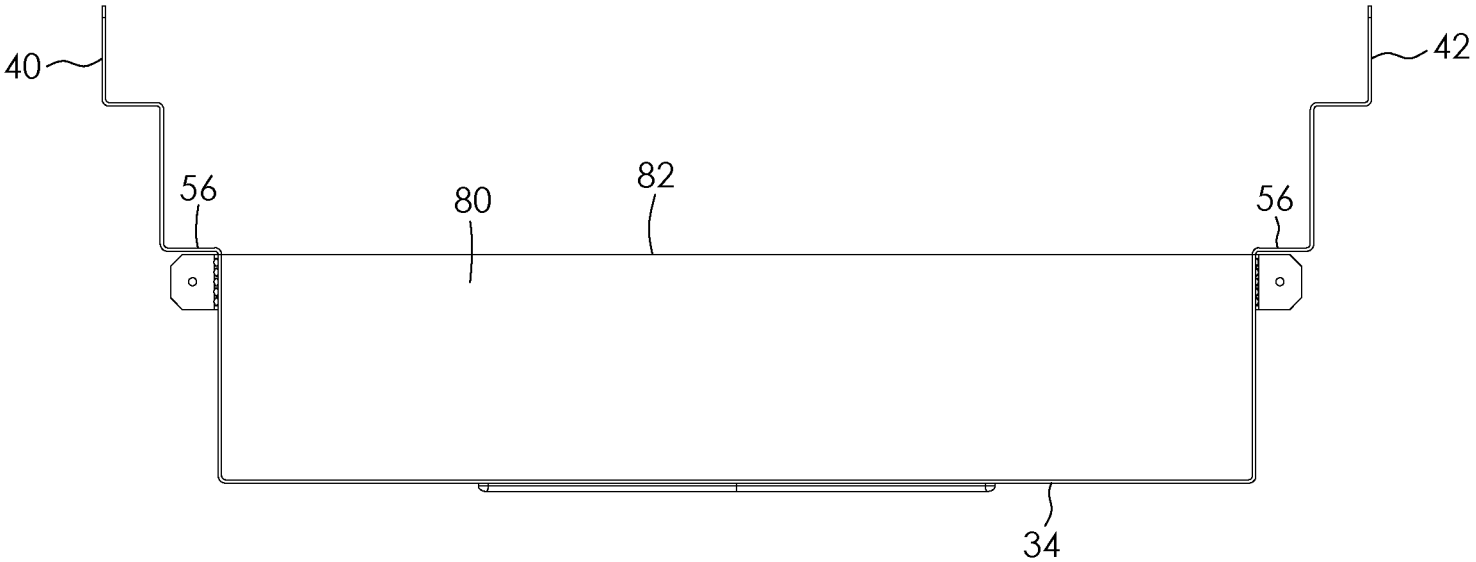

As shown in FIG. 2A, the firebox 32 has a back 34 with an upper end 36 and a lower end 38, a first side 40 and a second side 42. Both the first side 40 and the second side 42 extend between the upper end 36 and the lower end 38 and have two steps 44 and 46 that extend outward from the back 34. As shown in FIG. 2B, the first riser 50, the second riser 64 and the third riser 66 are normal to the back 34 and the first flange 56 and the second flange 58 are parallel to the back 34. As shown in FIG. 2C, a first riser lower end 52 (of the first riser 50) angles downward from the lower end 38 at about a 45 to a 90 degree angle, preferably a fifty degree angle 54. Thus, the first flange 56 and the second flange 58 of the steps 44, 46, respectively, extends beyond the length 60 of the back 34 at the lower end 38. The sides 40, 42 have a step 62 between the back 34 at the upper end 36 and the first riser 50. Thus, as shown in FIG. 2D, the upper ends 59 of the steps 44, 46 extend above the upper end 36 of the back 34. The second riser 64, the second flange 58 and the third riser 66 are the same length as the first riser 50. Again, the risers 64, 66 are normal to the back 34 and to the flanges 56, 58. A pair of combustion fan apertures 70 are proximate the lower end 38. A firebox base 72 is located directly above the combustion fan apertures 70 and extends between the first side 40 and the second side 42, parallel to the lower end 38. It is attached to the back 34 and abuts the first riser 50 on each side 40, 42. The first riser 50, the firebox top 80 and the firebox base 72 define an opening 84 (see also FIG. 3A). As shown in FIG. 2E, the top 74 of the firebox base 72 is aligned with the first flange 56. It is attached to the back 34 and abuts the first riser 50 on each side 40, 42. As shown in FIG. 2F, the top 80 of the firebox 32 is aligned with the first flange 56, below the upper end 36 of the back 34. The top 80 extends between the first side 40 and the second side 42.

Figure 3A:
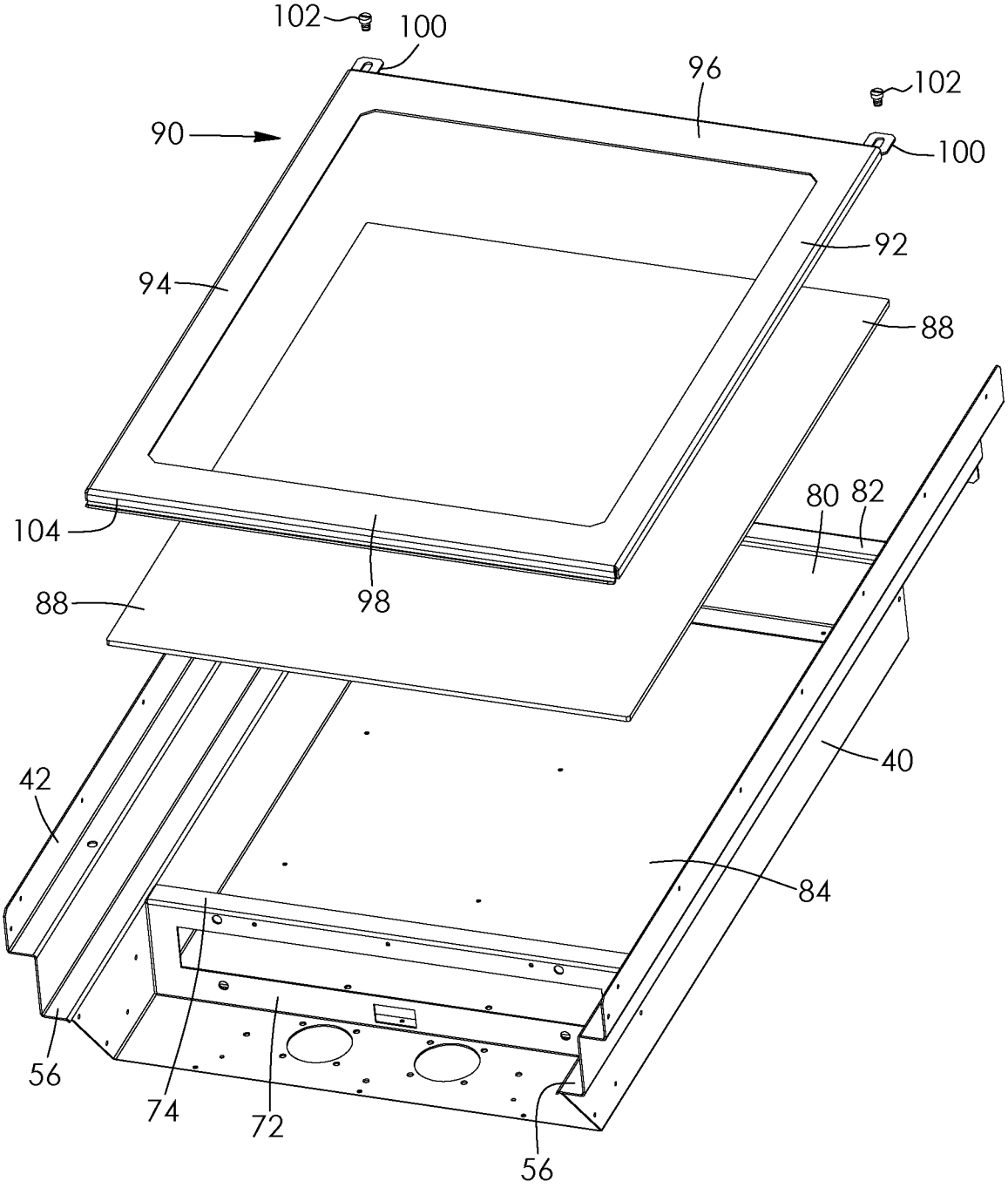
FIG. 3A is a perspective exploded view of the firebox and innermost glass pane.
Figure 3B:
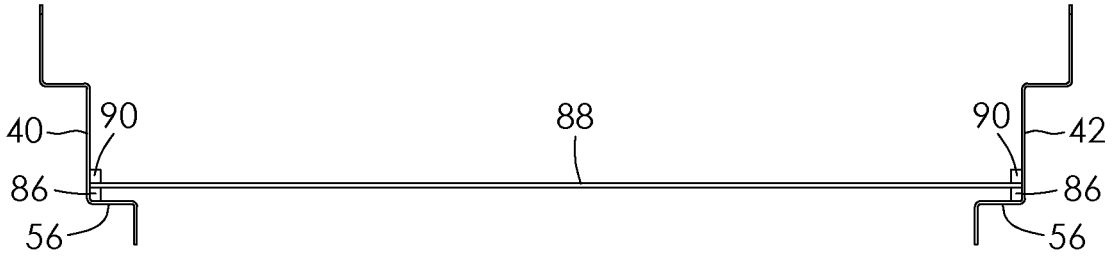
FIG. 3B is an end sectional view of FIG. 3A.

As shown in FIG. 3A, an innermost glass pane 88 is sized to cover the opening 84 and indirectly sits on the first flange 56 on both sides 40, 42 and on the top 74 of the firebox base 72 and the top 82 of the firebox top 80. As shown in FIG. 3B, a gasket 86 is sealed to the first flange 56 and the innermost glass pane 88. A frame 90 sits on the innermost glass pane 88. Returning to FIG. 3A, the frame 90 has a first side 92 and a second side 94 that are at least the width of the first flange 56, a top 96 that is at least the width of the top 82 of the firebox top 80 and a bottom 98 that is at least the width of the top 74 of the firebox base 72. The frame 90 is aligned with the first flange 56 and the top 74 of the firebox base 72 and the top 82 of the firebox top 80. Tabs 100 are attached to the top corners of the frame 90 and extend outward therefrom. Screws 102 affix the tabs 100 to the first flange 56. A base 104 along the bottom 98 hinges in to the firebox base 72.

Figure 4:
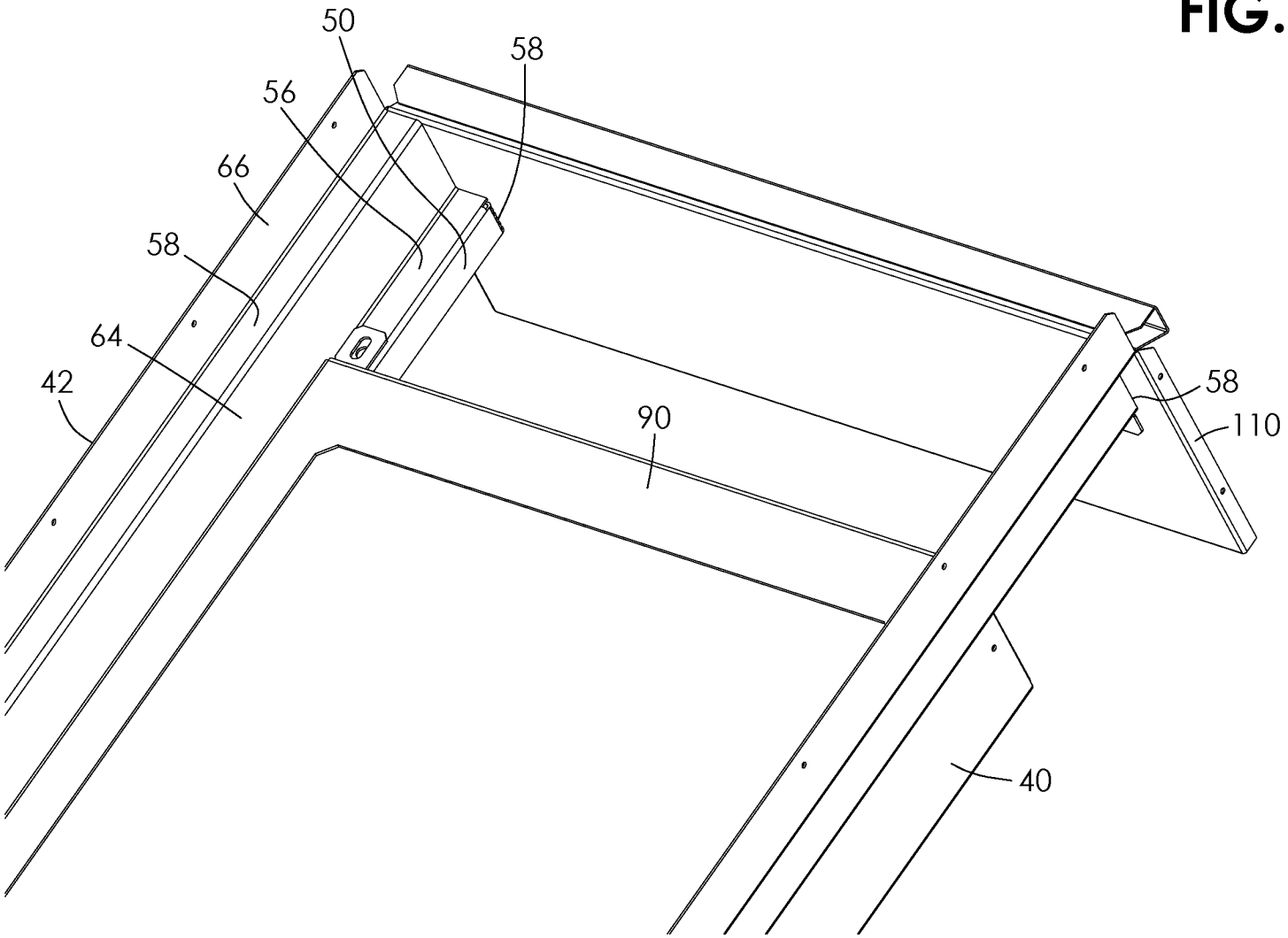
FIG. 4 is a perspective view of the top and the sides of the firebox.

As shown in FIG. 4, a middle glass (first) upper channel member 110 abuts the upper ends 58 of the sides 40 and 42 at the first riser 50, first flange 56, second riser 64 and second flange 58, but not the third riser 66.

Figure 5:
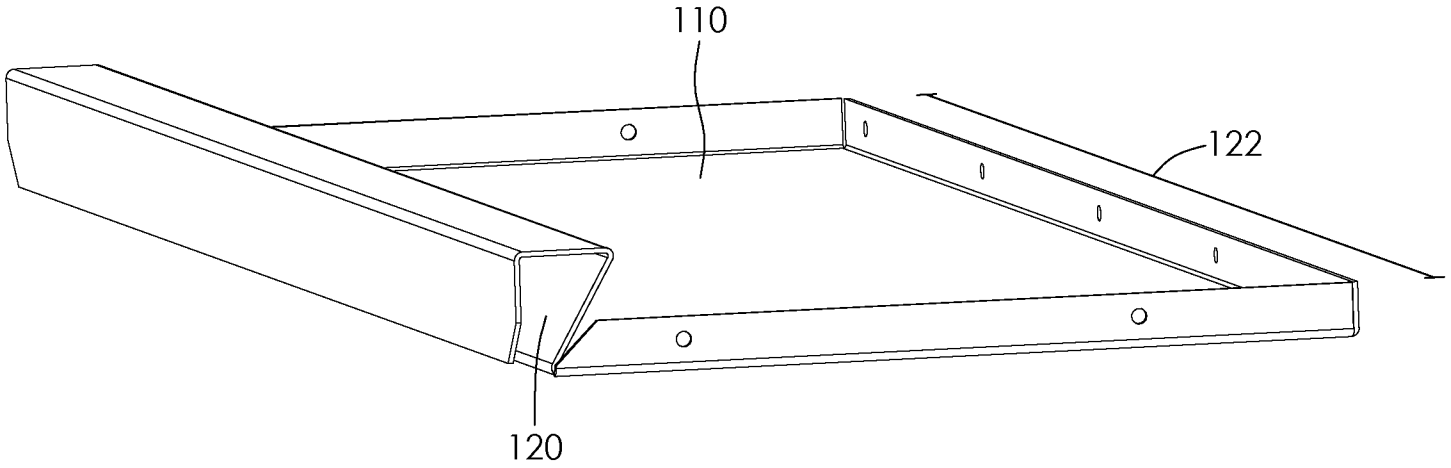
FIG. 5 is a perspective view of the middle glass channel member.

As shown in FIG. 5, a middle glass upper channel member 110 has a middle glass upper channel 120 that extends the width 122 of the middle glass upper channel member 110.

Figure 6A:
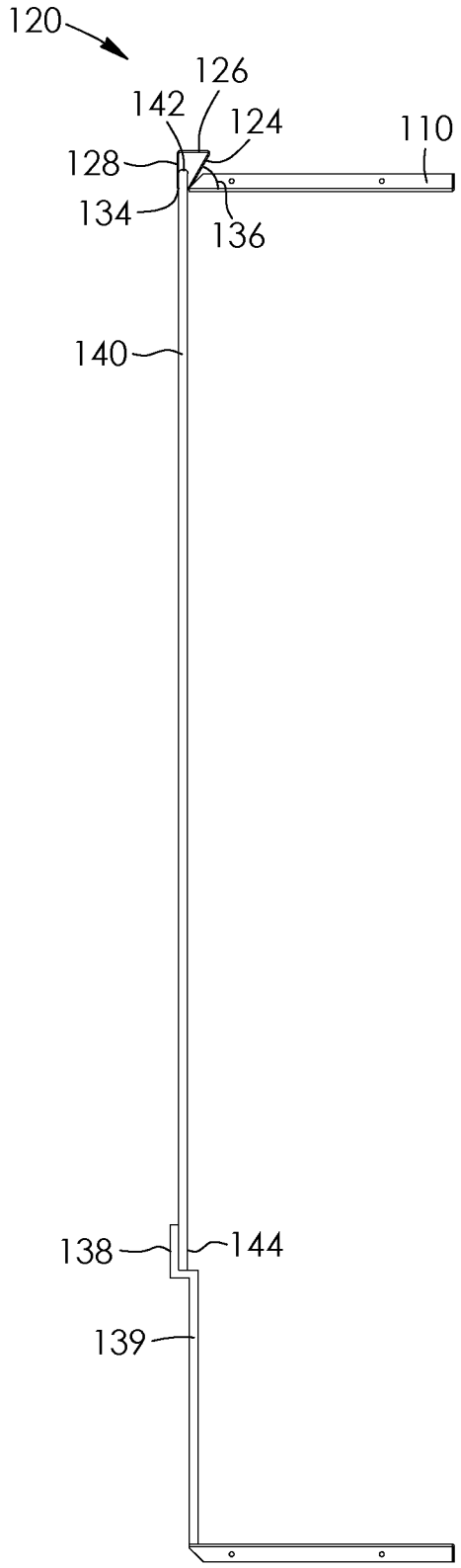
FIG. 6A is a side sectional view of the middle glass in the first channel member and the firebox base.
Figure 6B:
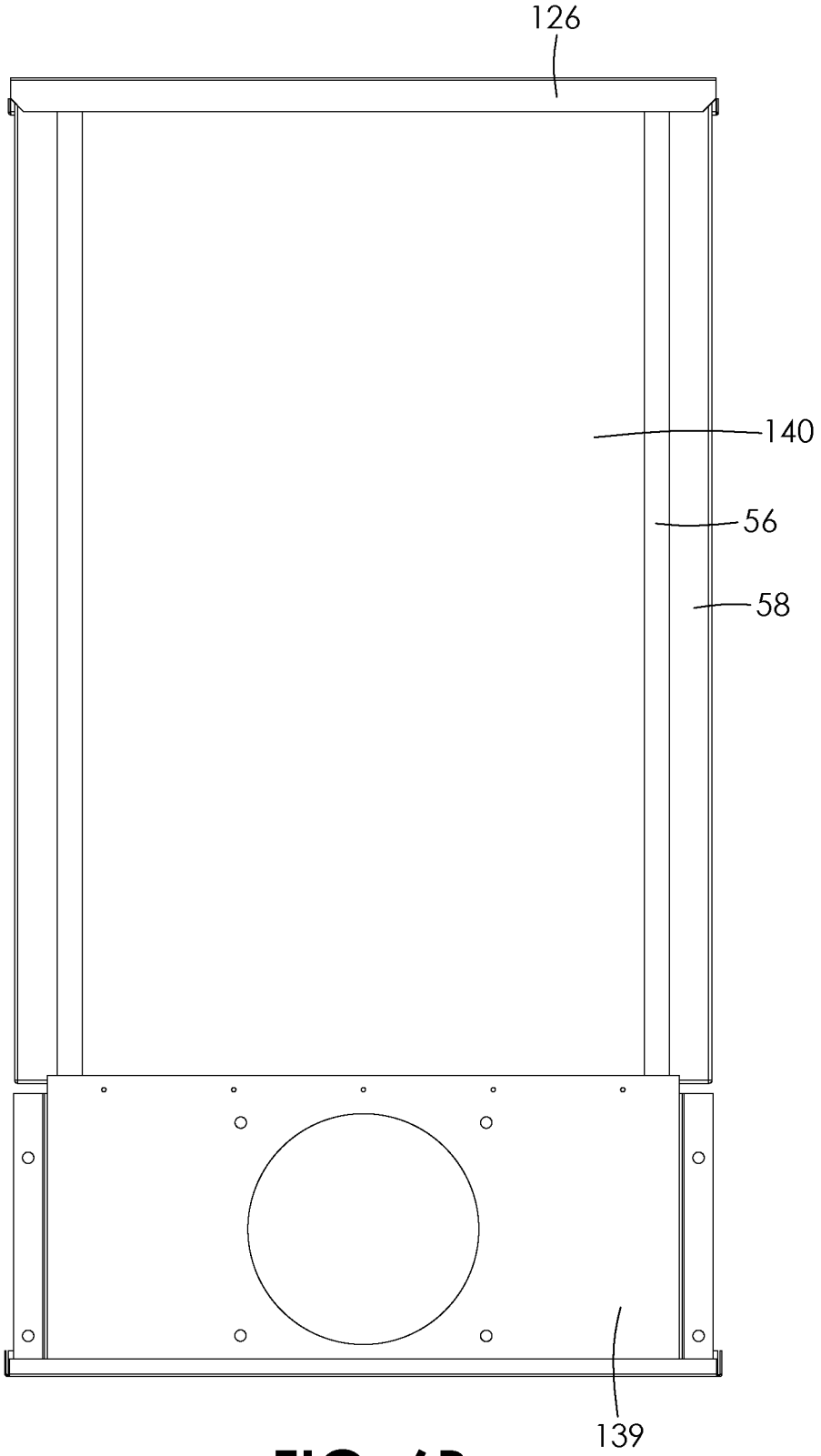
FIG. 6B is a front view of FIG. 6A.

As shown in FIG. 6A, the middle glass (first) upper channel 120 has a channel back 124, a channel top 126 and a channel front 128, with the channel back 124 and the channel front 128 defining a mouth 134. The channel back 124 angles downward from the mouth 134 towards the back 124 at an angle 136 of about 60 degrees. The mouth 134 of the middle glass upper channel 120 is disposed in front of the second flange 58. A first (middle glass) lip 138 is located on a fan bracket 139 to accept the middle glass pane 140 at its lower end 144, hence the fan bracket additionally functions as the middle glass lower channel member. The middle glass upper channel 120 allows a top section 142 of a middle glass pane 140 to slide into the middle glass upper channel 120 and therefore the middle glass pane 140 is positioned by angling the entire middle glass pane 140 and then dropping it into position on the second flange 58 (see FIG. 6B), lifting it upward and sliding a lower end 144 into the first lip 138. If the middle pane 140 needs to be removed, it can easily be removed by lifting it to remove the lower end 144 from the first lip 138, angling the middle glass pane 140 upward at an angle and retracting the top section 142 from the middle glass upper channel 120.

Figure 7A:
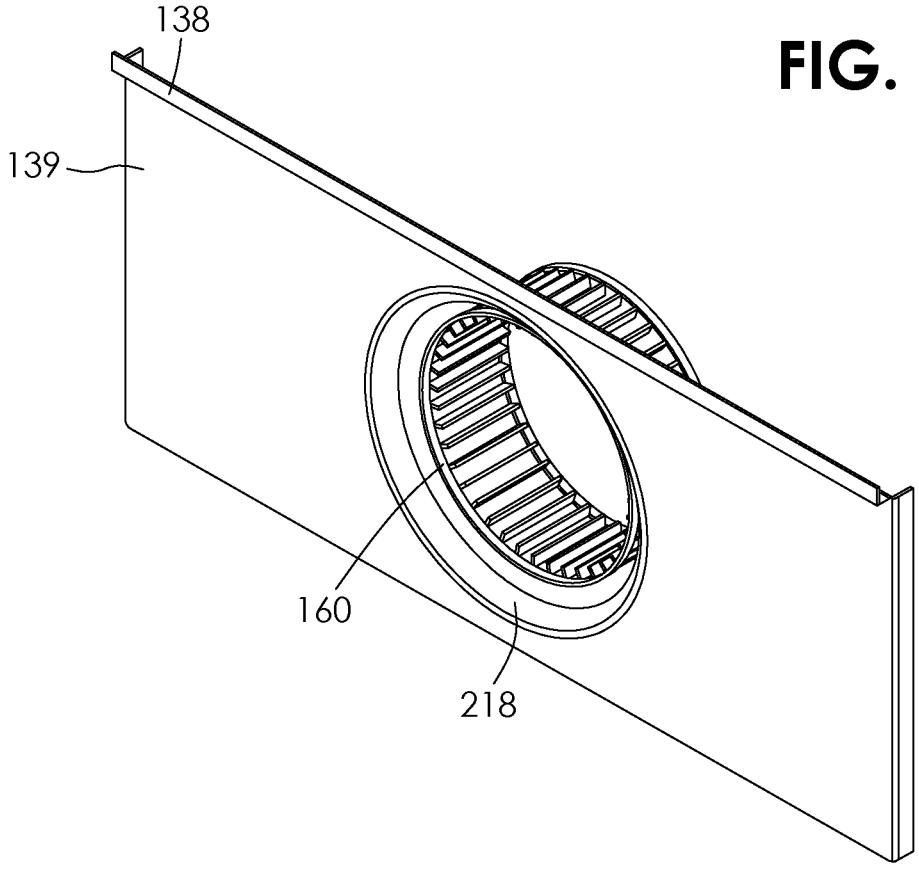
FIG. 7A is a perspective view of the circulating fans and fan bracket.
Figure 7B:
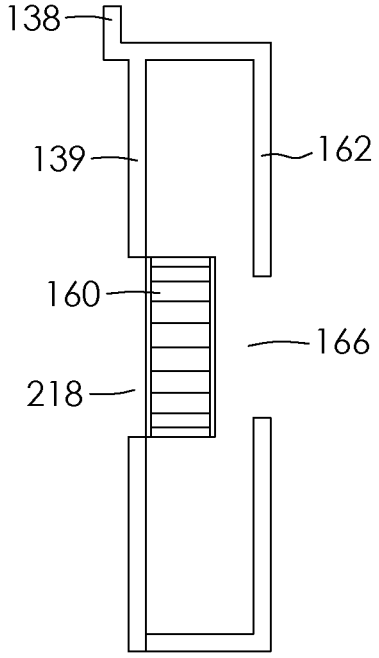
FIG. 7B is a top sectional view of FIG. 7A.

As shown in FIG. 7A one or more circulating fans 160 are mounted in circulating fan apertures 218 in the fan bracket 139. As shown in FIG. 7B, a fan cowl 162 covers the circulating fans 160 and is attached to the fan bracket 139. It has a slot 166 extending along a length such that the circulating fans 160 can release the incoming combustion air.

Figure 8A:
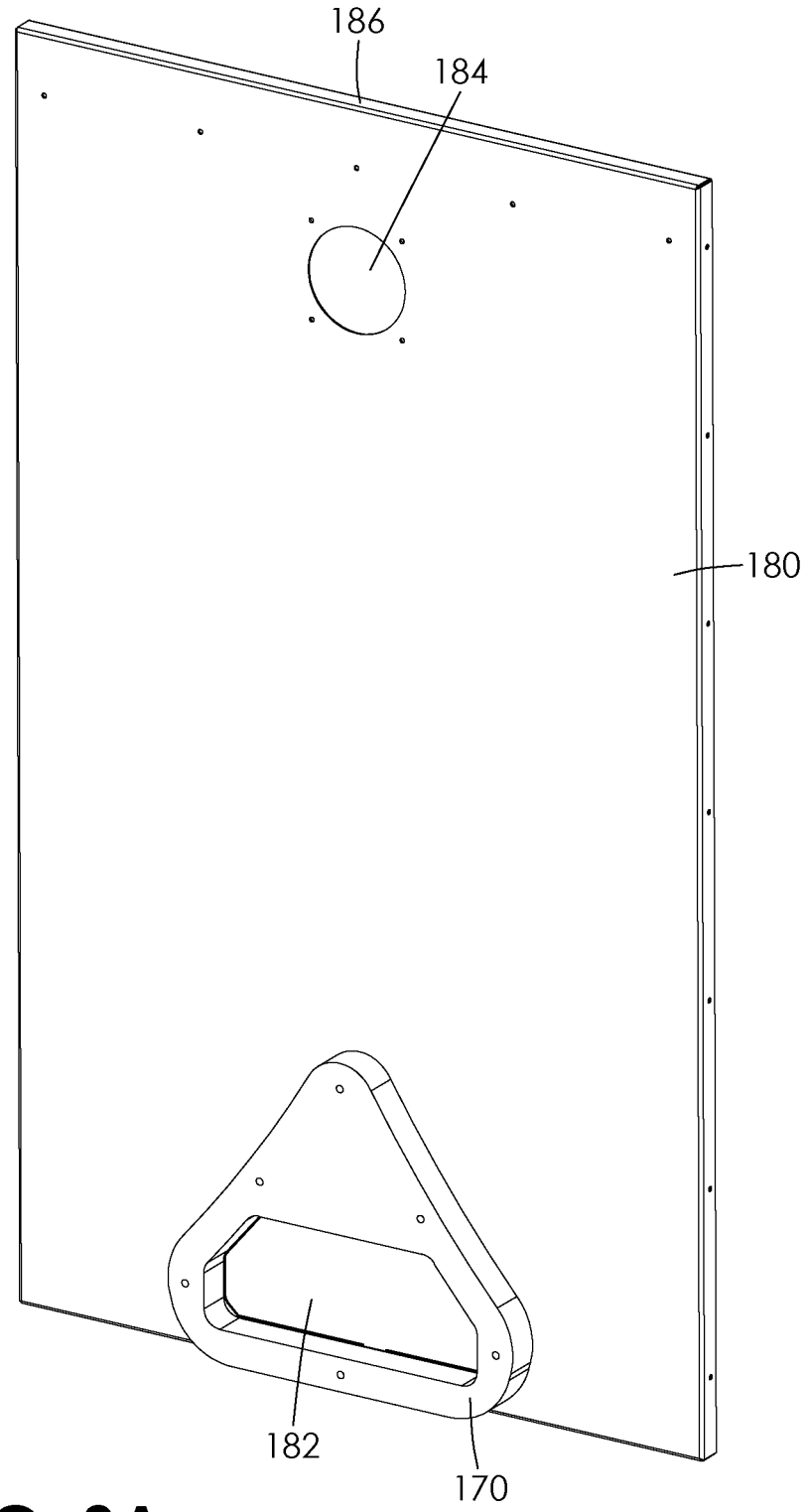
FIG. 8A is a perspective view of the air box-connector and the airbox face.
Figure 8B:
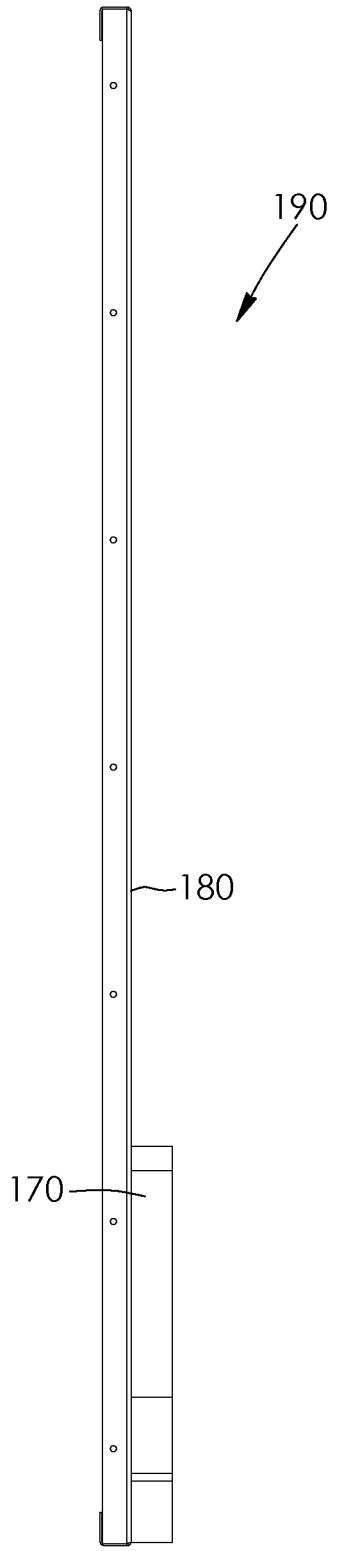
FIG. 8B is a side view of the air box-connector and the airbox face.

As shown in FIG. 8A an airbox connector 170 is connected to an airbox face 180, which has an airbox connector aperture 182 which is shaped to accept the airbox connector 170 and a round aperture 184 proximate the top end 186. As shown in FIG. 8B, the airbox connector 170 is attached to the airbox face 180 to provide an assembly 190.

Figure 9A:
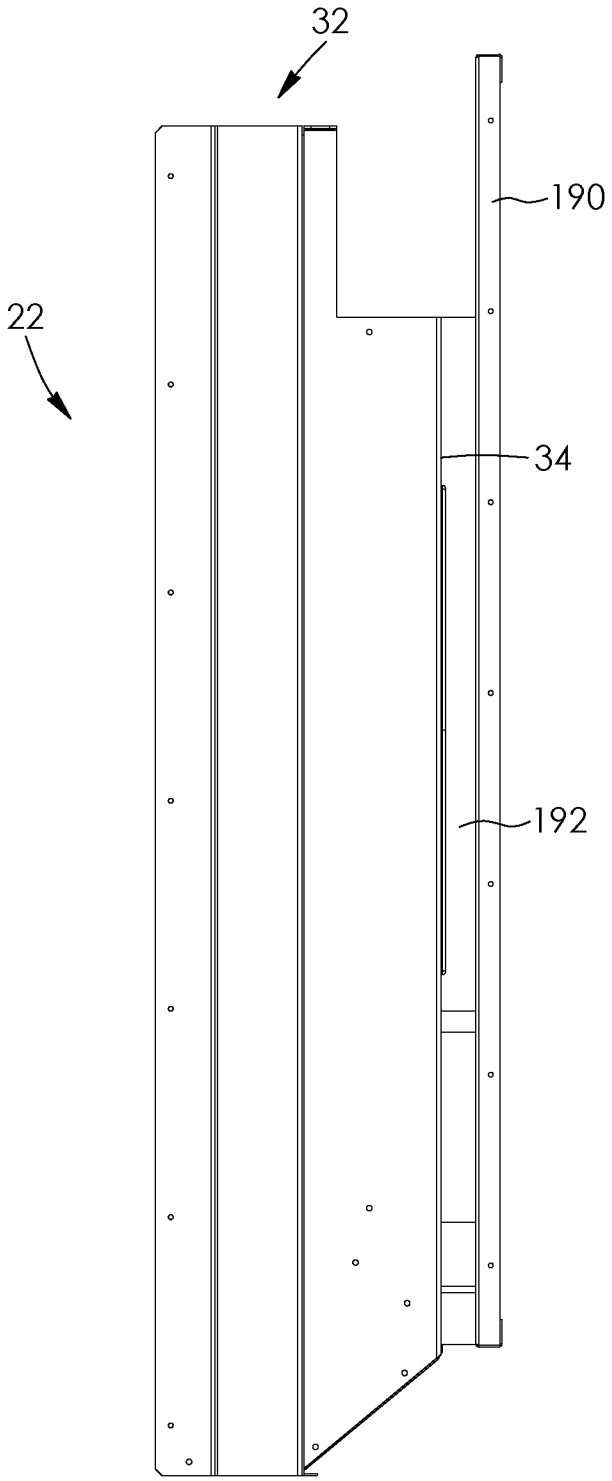
FIG. 9A is a side sectional view of the fireplace.
Figure 9B:
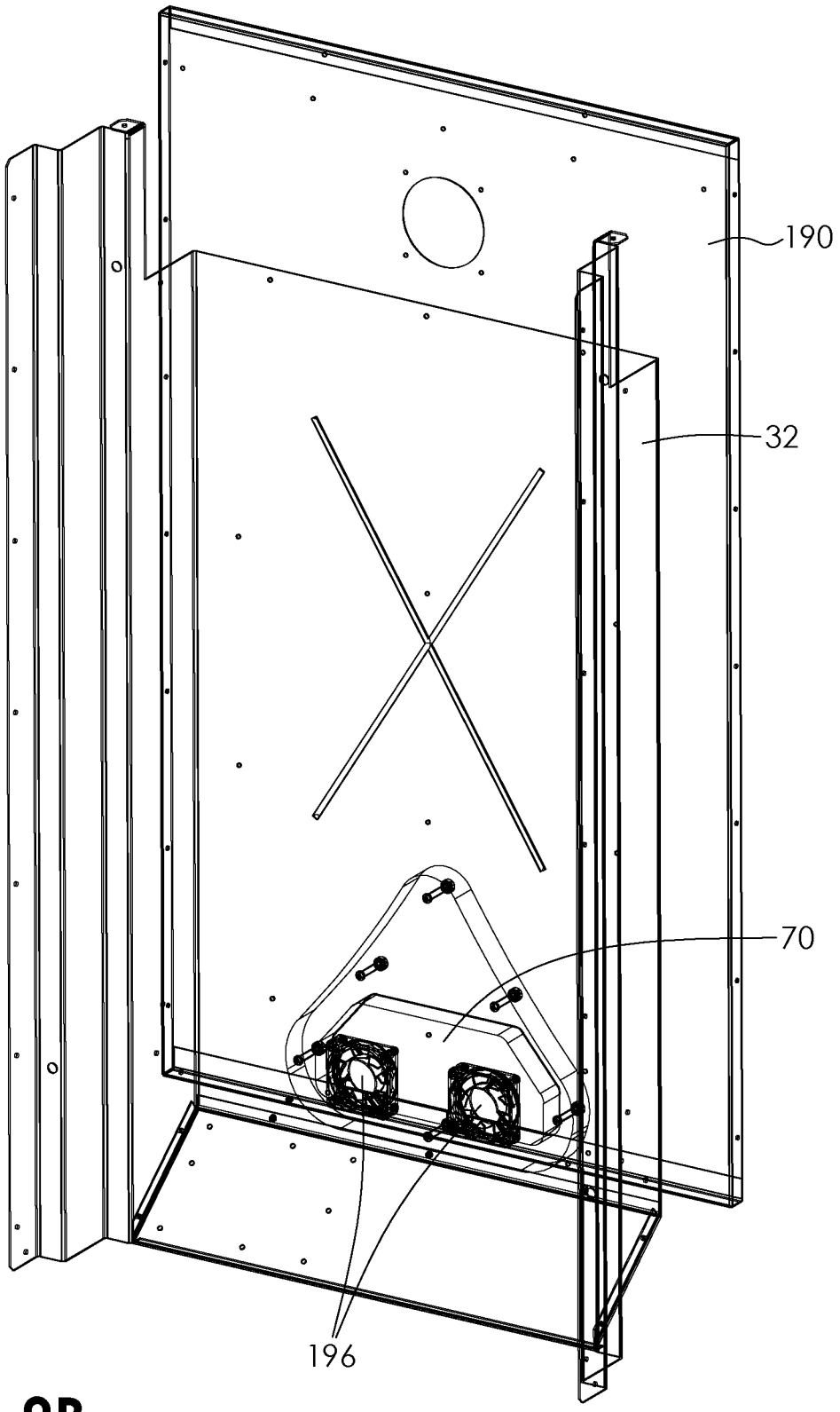
FIG. 9B shows the combustion fans in the firebox.

As shown in FIG. 9A, this assembly 190 is attached to the back 34 of the firebox 32 to provide the firebox assembly 22 and to define an air channel 192. As shown in FIG. 9B, two combustion fans 196 are located in the combustion fan apertures 70.

Figure 10:
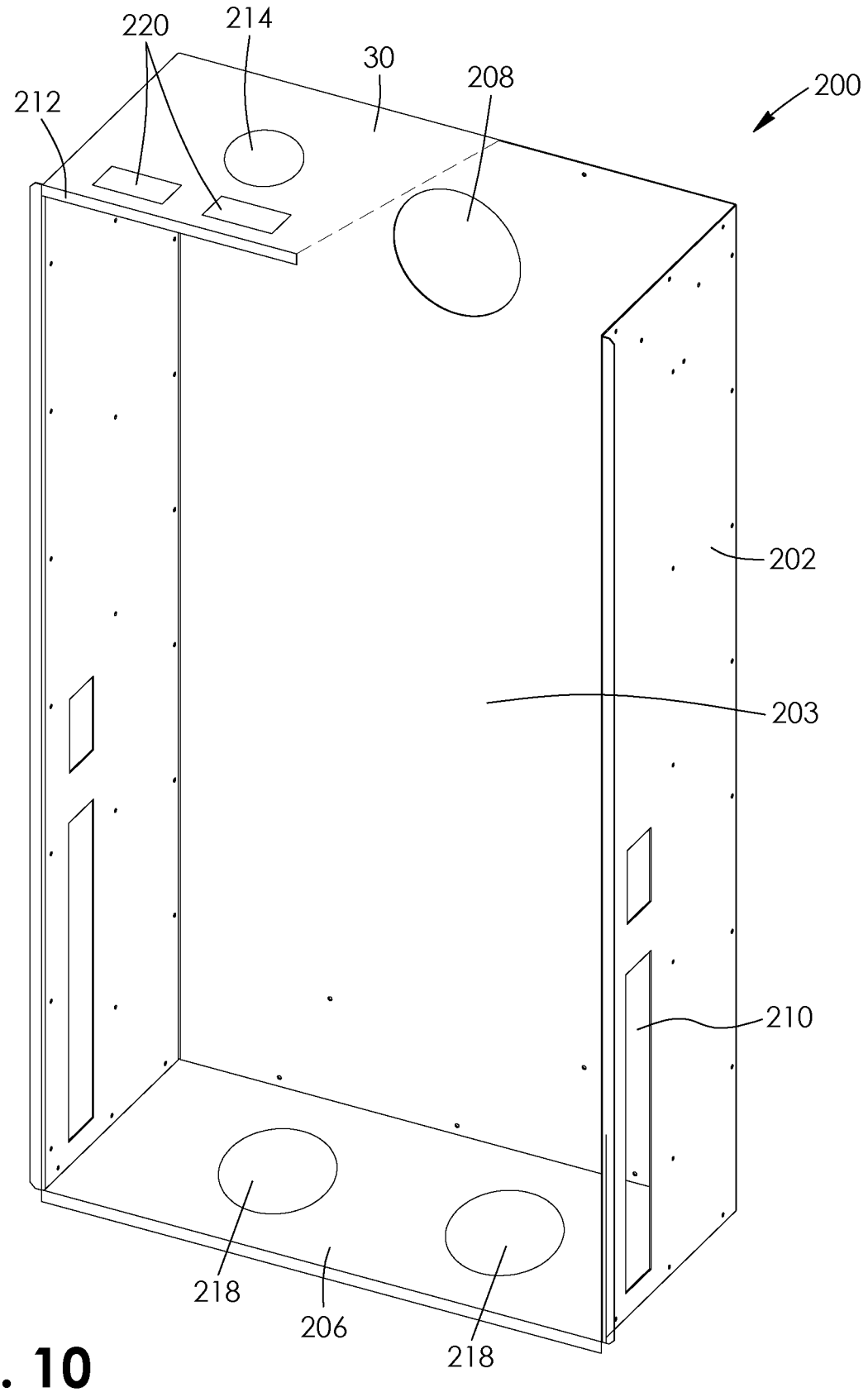
FIG. 10 is a perspective view of the outer case.
Figure 11:
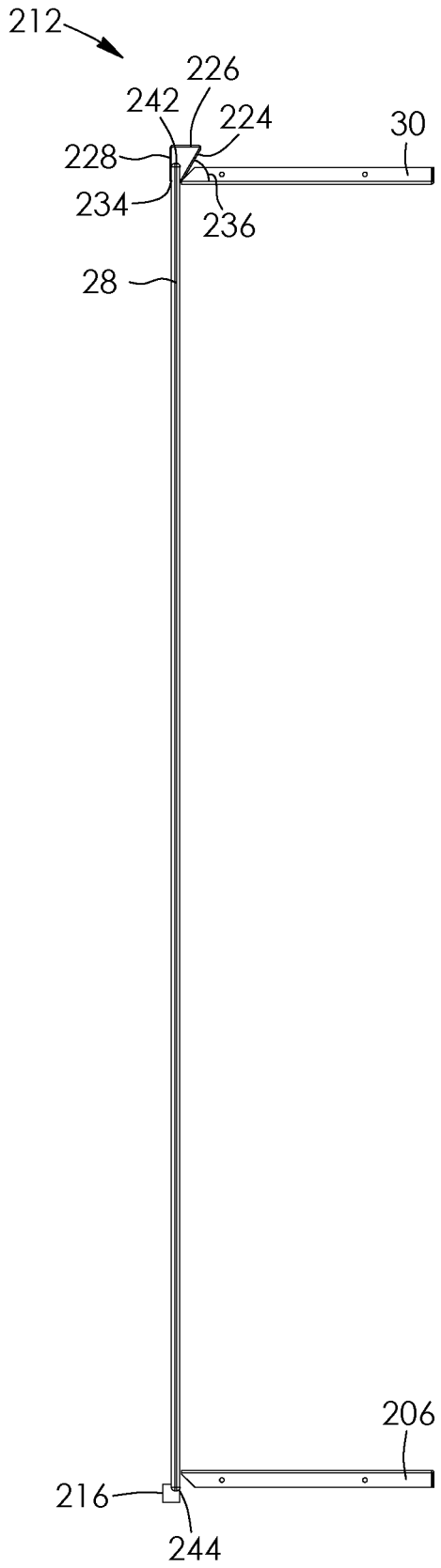
FIG. 11 is a side sectional view of the outer glass pane in the outer case top and outer case bottom.

As shown in FIG. 10 the outer box, generally referred to as 200 includes outer case sides 202, an outer case top 30, an outer case back 203 and an outer case bottom 206. The outer case back 203 includes an incoming air/exhaust flue 208. The outer case sides 202 include room air exhaust slots 210. Referring also to FIG. 11, the outer case top 30 includes an outer glass upper channel 212, hence it functions as an outer glass (second) upper channel member. The outer case top 30 includes a series of openings 220, which are for incoming air and a pair of apertures 214 for ducting air from other rooms. The outer case bottom 206 also has a pair of apertures 218 for ducting air to other rooms. As it has a second lip 216 it functions as an outer glass lower channel member. Returning to FIG. 8A, the exhaust flue 208 is aligned with the round aperture 184 of the airbox face 180.

Referring to FIG. 11, the outer glass (second) upper channel 212 has a channel back 224, a channel top 226 and a channel front 228, with the channel back 224 and the channel front 228 defining a mouth 234. The channel back 224 angles downward from the mouth 234 towards the back 224 at an angle 236 of about 60 degrees.

The second (outer glass) lower lip 216 accepts the outer glass pane 28 at its lower end 244. The outer glass upper channel 212 allows a top section 242 of the outer glass pane 28 to slide into the outer glass upper channel 212 and therefore the outer glass pane 28 is positioned by angling the entire outer glass pane 28 and then dropping it into position on the third riser 66, lifting it upward and sliding a lower end 244 into the second lower lip 216. If the outer glass pane 28 needs to be removed, it can easily be removed by lifting it to remove the lower end 244 from the second lower lip 216, angling the outer glass pane 28 upward at an angle and retracting the top section 242 from the outer glass upper channel 212.

Decorative wraps are attached to the fireplace 10 to complete the design. These include firebox bottom wrap and vertical decorative panels. The outer glass pane is preferably tinted.

Figure 12:
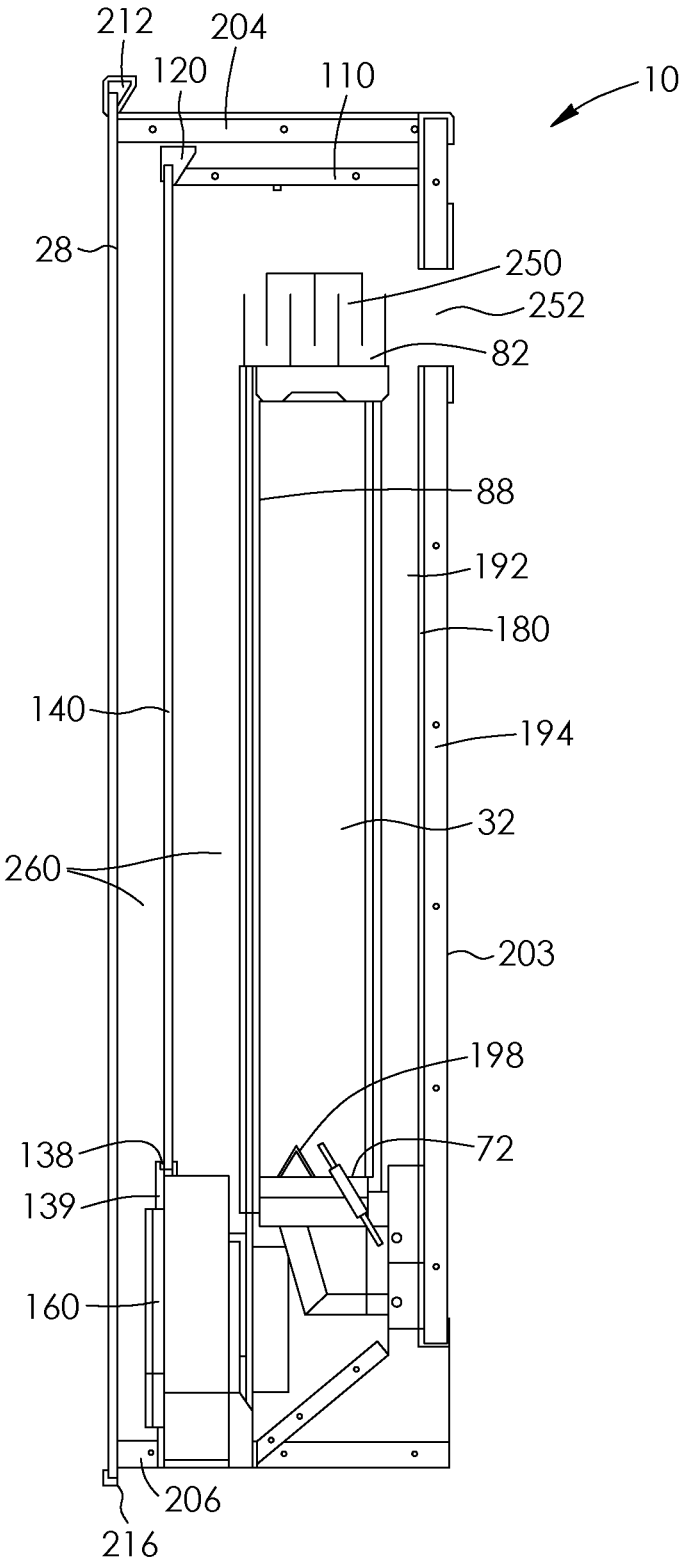
FIG. 12 is a sectional view of the fireplace.

A sectional view of the fireplace 10 is shown in FIG. 12. An airbox 194 is defined by the outer case back 203 and the airbox face 180. The circulating fans 160 circulate air in the interstitial spaces 260 between the panes of glass 28, 140, 88. A burner assembly 198 is located in the firebox base 72 of the firebox assembly 22. A heat exchanger 250 is mounted on the top 82 of the firebox top 80. A vent 252 vents combustion air from the heat exchanger 250 to the ambient outside air.

By increasing the number of steps in the sides, for example, but not limited to a third flange, a fourth riser, a fourth flange and a fifth riser, the number of panes of glass can be increased. In order to releasably retain the panes of glass, additional upper channel members and lower channel members are required. Each successive upper channel member and its respective lower channel member will extend outward from the front of the firebox assembly so as to be aligned with the respective pair of flanges or pair of risers and will be mounted above the previous channel member in the case of the upper channel members, and below the previous channel member in the case of the lower channel members.

In an alternative embodiment, the second upper channel member is attached to the sides and is a separate component rather than being the top of the outer case. Similarly, the second lower channel member is attached to the sides and is a separate component rather than being the fan bracket. Subsequent channel members are also attached to the sides. The outermost upper and lower channel members may be the top of the outer case and the fan bracket. In the preferred embodiment, the outermost pane of glass is sized to cover the opening defined by the outer case, hence it is larger than the inner pane, the middle pane and any intervening panes.

Figure 13:
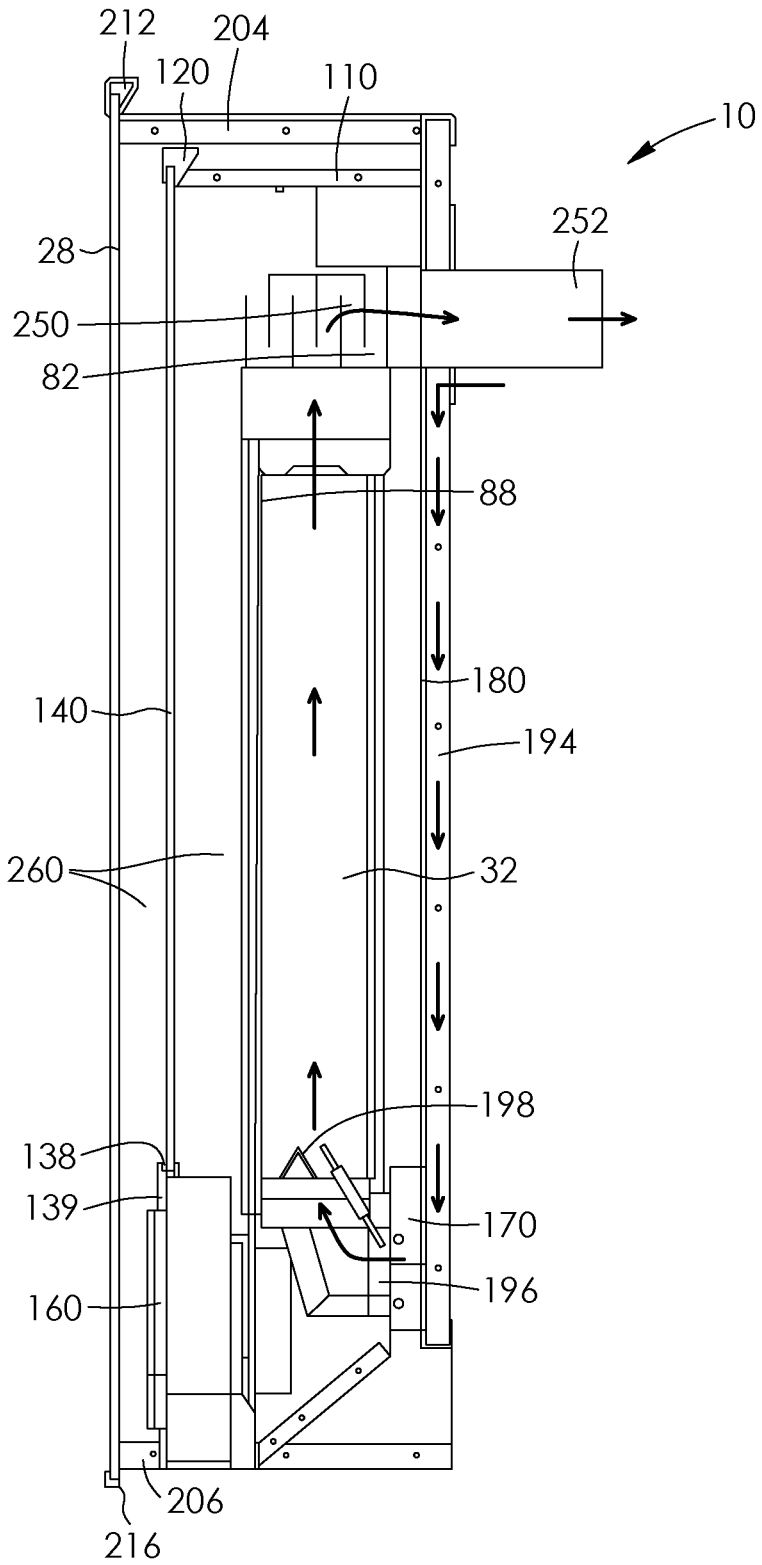
FIG. 13 shows the flow path of combustion air.

As shown in FIG. 13, combustion air enters the airbox 194, often around the exhaust flue 252 to act as a coolant. The air is drawn down the airbox 194 by the combustion fans or gravity. The air passes through the airbox connector 170 and through the combustion fans 196. The air is then swept up and around the burner and is used for combustion. The hot gases travel up through the firebox and enter the heat exchanger 250. They then exit the fireplace through the exhaust flue 252.

Figure 14:
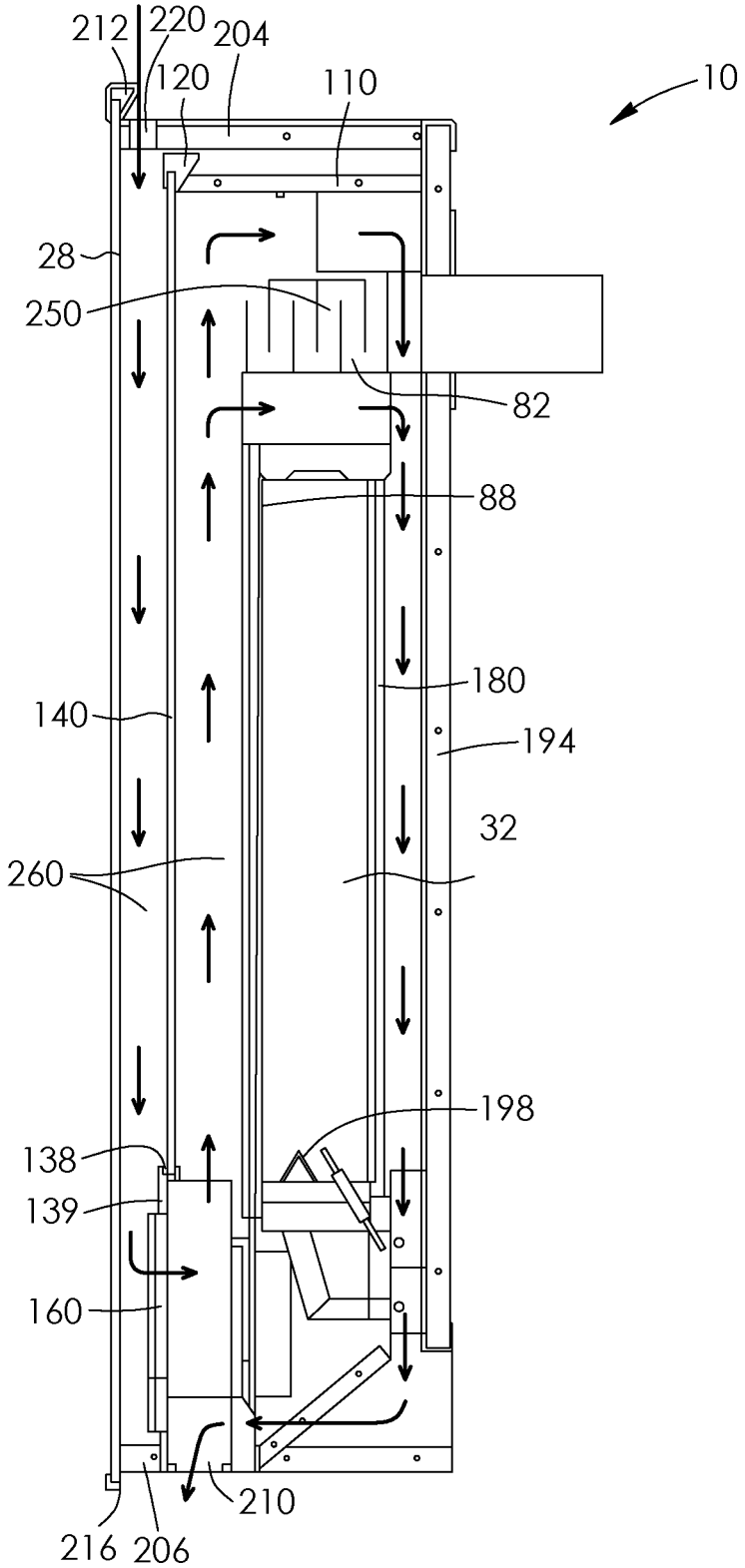
FIG. 14 shows the flow path of ambient air.

As shown in FIG. 14, room air enters the fireplace through the opening 220 in the top 204. Air is swept down the first channel, between glasses 28 and 140. The air is then pulled into the circulation fan(s) and forced up through the second space between the glass sheets 140 and 88. The air then passes around the outside of the heat exchanger 250, drawing off the heat from the exhaust gases which are contained on the inside of this heat exchanger. The warmed air now passes down the back of the firebox, in the channel 192. The warmed air is also passing down the edges of the firebox. The air then exits the fireplace through the side opening 210.

In alternate embodiments, the room air can be ducted to the fireplace, and enter though the top 30 by way of the openings 214. After the air is warmed in its circuitous path, it can be ducted from the fireplace by exiting through the bottom 216 by way of the apertures 218.

Figure 15:
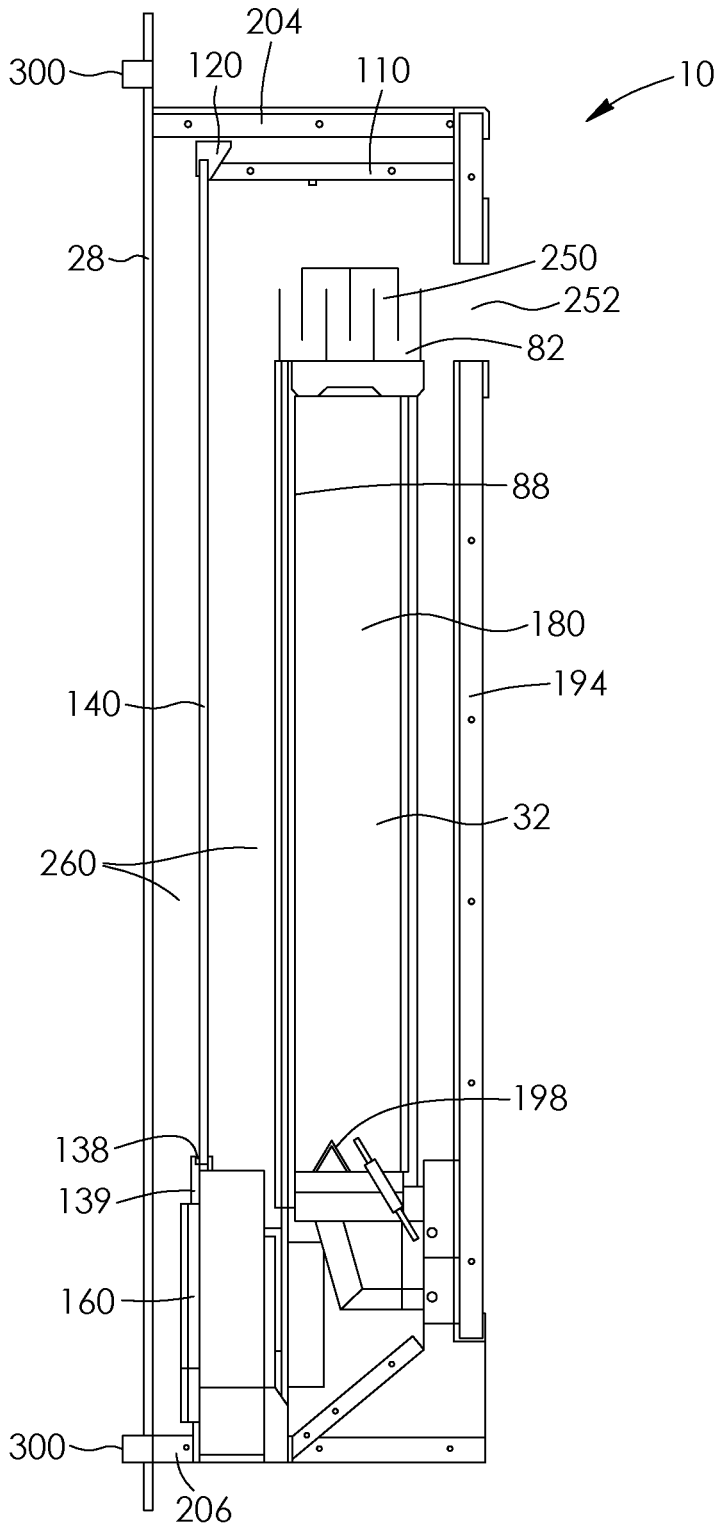
FIG. 15 shows an alternative embodiment of the fireplace of FIG. 1.

In another alternative embodiment, shown in FIG. 15, the outer pane of glass 28 is retained with clips 300.

The method of manufacture follows:

Assembly Instructions:

The metal components of the fireplace total about 25 parts, preferably about 20 parts, as compared to the 70 or more metal parts of the prior art. Many of the components are multipurpose, for example, the outer case bottom also functions as an outer glass lower channel member. The outer pane and/or the outer case can be easily replaced, whether for aesthetics or repair.

For the purposes of fabrication, the orientation of the unit is defined with the back facing the wall and the front facing the room, when installed. The back will be the part that has the intake air and exhaust flue projecting from it. Top and bottom are understood and left and right do not matter as most parts are symmetrical along a vertical center line.

There are three major metal boxes, along with a variety of smaller metal fittings and pieces. The primary part is the firebox 32. There is also the airbox face 180 and the outer case 200.

The firebox 32 is positioned on a workbench at a comfortable riveting height. The first pieces being added to the firebox 32 are meant to stiffen up the firebox.

The firebox base 72 and fan cowl 162 are attached. Firebox base 72 is positioned just above the fans 196 on the firebox 32. The long side with the rivet holes is in contact with the firebox 32, and the smooth side without any rivet holes is away from the back 34 of the firebox 32. Riveting is likely done blind from the back of the firebox towards the part.

The firebox top 80 is riveted to the top of the firebox with the flanges facing down on the firebox 32. There are only rivets on one side of the flanges, so the rivet holes face the back of the firebox 32.

The airbox connector 170 is a gasket that is bolted between the airbox face 180 and the firebox 32.

The burner top has tabs that will be on the back side, to support the holder for the glow plug and sensor. The top is added so that the sensor holder tabs will be on the back, with the mixing chamber coming out with input to the right to meet up with the gas line from the valve. This is the right side looking from the front. Attached to the burner bottom is the mixing chamber, and all three pieces are riveted together. Though the burner assembly is riveted top to bottom, there will also be some welding at the ends.

The burner assembly is positioned in the firebox base 72 with the gas mixing segment on the right hand side where it will align with the orifice and gas line coming from the gas valve.

The innermost glass pane 88 is located on a gasket 86, which sits on the first flange 56. The frame 90 is attached to the first flange 90 and holds the innermost glass pane 88 firmly in place. Once affixed to the first flange 56, there is a tight seal.

The middle glass upper channel member 110 is positioned at the top 74 of the firebox 32. Prior to attachment, the two tabs at the top of the firebox 32 are bent to 90° and face towards the back 34 of the firebox 32. These will be used as mounting tabs for the middle glass channel member 110. This part is positioned with the middle glass upper channel 120 facing towards the front of the firebox 32 and the mouth 134 of the channel 120 facing down so the glass pane 140 will be able to fit into the channel.

The operator now moves to the bottom of the firebox to attach the firebox wrap bottom. This part is positioned so the flange with the rivet holes is facing up. This flange is riveted to the back of the firebox just below the fan openings 70.

The firebox assembly 22 is turned over so the firebox 32 is facing down. The assembly 190 is positioned with its edges facing away from the firebox 32, the round aperture 184 near the top of the firebox 32 and the airbox connector aperture 182 proximate the bottom of the firebox 32. The holes on the airbox connector 170 align with the holes on the back 34 of the firebox 32.

Since the firebox assembly 22 is lying on its front, it is easy to place the outer box 202 onto it. It is positioned so that the exhaust flue 208 is aligned with the airbox round aperture 184. The outer case top 204 and the outer case bottom 206 are riveted to the outer box 202 to provide the outer case 20.

The assembly is now turned over. It is best if the edge of the firebox 32 with the assembly 190 is hanging over the edge of the of the workbench. Two combustion fans 196 are bolted to the combustion fan apertures 70 in the firebox 32. The fans are mono-directional and should be positioned so that the labels face towards the operator. When bolting them in, the power and control wires for the fans should point towards the bottom of the firebox (as that is where the controller will be). To protect the wires they are guided through the hole in a horseshoe grommet, along with the wires from the glow plug and sensor set. The combustion fans can also be mounted to a circuit board, and then mounted as a single unit to the firebox.

The firebox bottom wrap is attached to the assembly and the circulating fan cowl 162 is attached, with the latter covering the two small combustion fans 196.

A circulating fan mount is placed over the back of the circulating fan(s) and bolted to it. This assembly is then joined to the circulating fan cover 139.

A rail is attached to the fan bracket 139 to provide the middle glass (first) lip 138. The middle glass upper channel 120 allows a top section 142 of a middle glass pane 140 to slide into the middle glass upper channel 120 and therefore the middle glass pane 140 is positioned by angling the entire middle glass pane 140 and then dropping it into position on the second flange 58, lifting it upward and sliding a lower end 144 into the first lip 138.

The U shaped second lower lip 216 accepts the outer glass pane 28 at its lower end 244. The second upper channel 212 allows a top section 242 of the outer glass pane 28 to slide into the second upper channel 212 and therefore the outer glass pane 28 is positioned by angling the entire outer glass pane 28 and then dropping it into position on the third riser 66, lifting it upward and sliding a lower end 244 into the second lower lip 216.

There are approximately seven parts which are used to finish the interior of the firebox 32. The back decorative panels 24 are mounted on panel supports. A burner cover plate is then inserted over the burner. The opening is at the back of the cover to fit around the glow plug and sensor assembly. The side decorative panels 24 are then attached and are used to support a firebox baffle near the top of the firebox opening.

The gas valve, power supply and control board are then installed. The front glass panels are also installed, and the unit is then ready for testing. As can be understood from the foregoing, the method of assembling the unit is intuitive and involves much fewer parts than the fireplaces of the prior art.

Figure 16A:
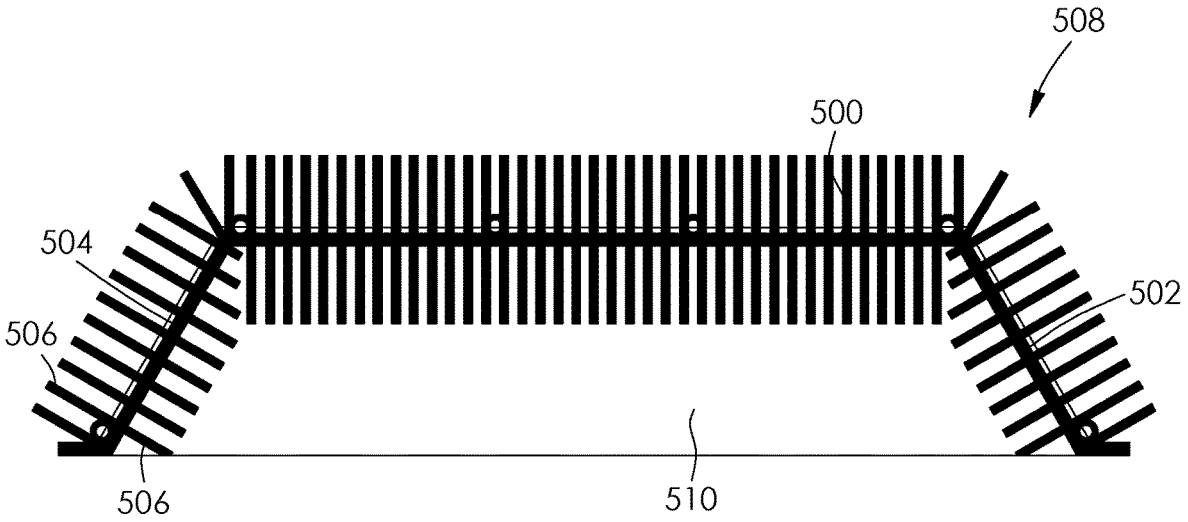
FIG. 16A shows a top sectional view of an alternative embodiment of the firebox of the fireplace of FIG. 1.
Figure 16B:
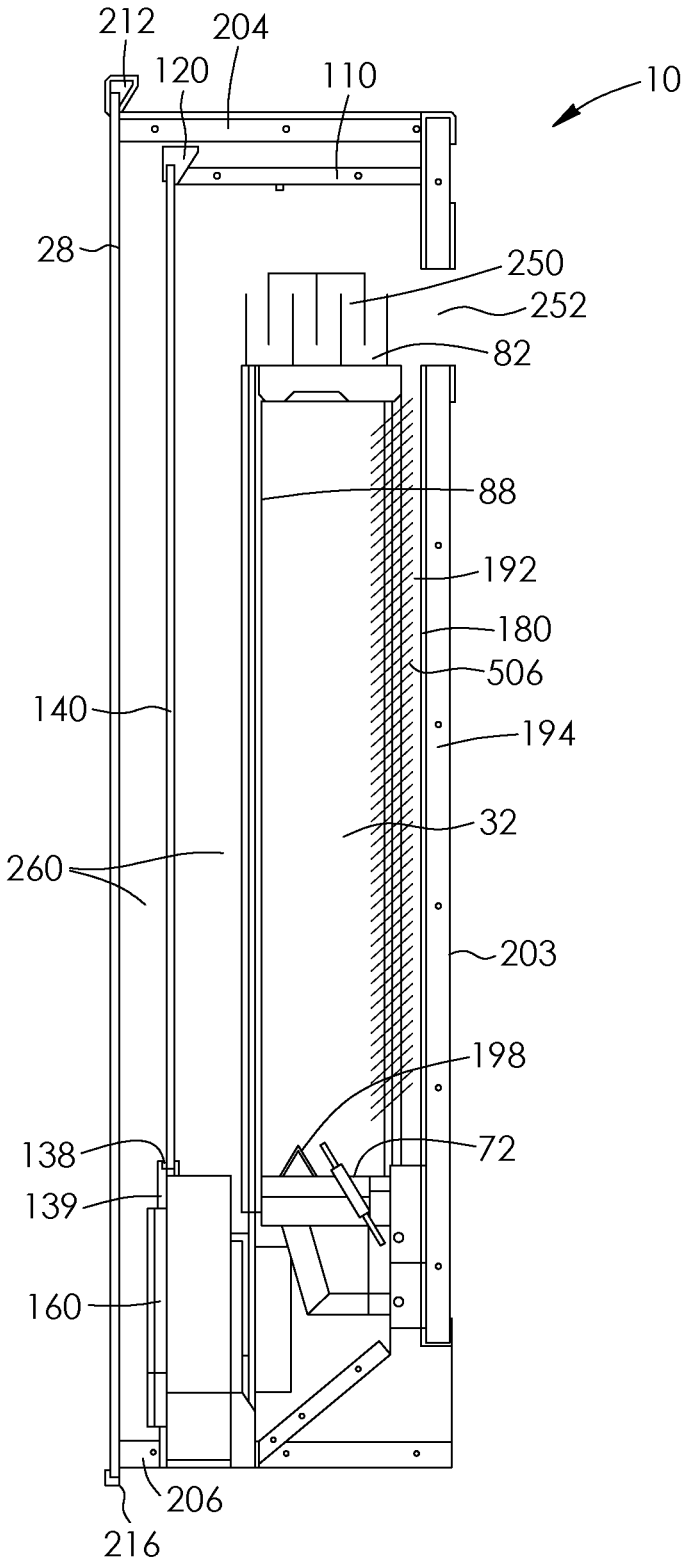
FIG. 16B shows a side sectional view of the fireplace.

As shown in FIG. 16A and FIG. 16B in an alternative embodiment the back 500, the first side 502 and a second side 504 all have fins 506 and are extruded as a single unit, generally referred to as 508. The sides 502 and 504 are angled outward from the back 500 to increase the volume of room air. The fins 506 extend inward into the combustion chamber 510 and outward into the air channel 192 to increase heat exchange.

As shown in FIG. 17A, in another alternative embodiment, the back 600, the first side 602 and a second side 604 all have fins 606 and are extruded as a single unit, generally referred to as 608. The sides 602 and 604 are angled outward from the back 600. The fins 506 extend inward into the combustion chamber 610 and outward into the combustion gas flue 614. Another set of fins 606 extend out from the combustion gas flue wall 616 into the air channel 192. As shown in FIG. 17B, in another alternative embodiment, the back 600, the first side 602 and a second side 604 all have fins 606 and are extruded as a single unit, generally referred to as 608. The sides 602 and 604 are angled outward from the back 600. The fins 506 extend inward into the combustion chamber 610 and outward into a channel 640 for either combustion gases or outside air, through the channel wall 642 into the air channel 192. The fins 606 may be vertical, horizontal or angled and may be of varying heights.

As shown in FIG. 18A, in either embodiment shown in FIGS. 16A and B and 17A and B, in yet another embodiment, there is a right back section 650 which is continuous with the first side 652 and a left back section 654 that is continuous with the second side 656. They may be provided as two extrusions. As shown in FIG. 18B, a middle back section 658 allows for the width of the firebox to be varied without making changes to the extrusions. The two extrusions and the middle back section 658 all have fins 506. The sides 652 and 656 are angled outward from the back sections 650, 654. As shown in FIG. 18C, there may be two side extrusions 652, 656 and two back extrusions 650, 651.

FIG. 19A shows plain box-shaped fins 506; FIG. 19B shows box-shaped fins 506 with perforations 520; FIG. 19C shows box-shaped fins 506 with serrations 522; FIG. 19D shows herringbone fins 506; FIG. 19E shows wavy fins 506; and FIG. 19F shows double wavy fins 506, with a solid core 524 and FIG. 19G shows solid double wavy fins 506 with a solid core 524.

While example embodiments have been described in connection with what is presently considered to be an example of a possible most practical and/or suitable embodiment, it is to be understood that the descriptions are not to be limited to the disclosed embodiments, but on the contrary, is intended to cover various modifications and equivalent arrangements included within the spirit and scope of the example embodiment. Those skilled in the art will recognize or be able to ascertain using no more than routine experimentation, many equivalents to the specific example embodiments specifically described herein. Such equivalents are intended to be encompassed in the scope of the claims, if appended hereto or subsequently filed.

The invention claimed is:

1. A firebox for a gas fireplace, the firebox comprising: a back which includes at least one combustion fan aperture, an upper end and a lower end and a length therebetween; a pair of sides, each side including an upper end, a lower end, a first riser which has an inner section and an outer section, the inner section attached to the back, a first flange, which is parallel to the back and extends outward from the back, and a second riser, wherein the outer section of the first riser, the first flange and the second riser extend above the upper end of the back and below the lower end of the back; a top which is attached to the inner section of the first risers and to the back at the upper end; a base which is attached to the inner section of the first risers and to the back above the combustion fan aperture, to define an opening; a first glass upper channel member attached to the upper end of each side at the first risers and the first flanges, the first glass upper channel member including a first glass upper channel including a channel back, a channel top and a channel front, the channel back and the channel front defining a mouth, the channel back angled from the mouth towards the back to define an angled channel, the mouth disposed in front of the first flange; and a first lower channel member attached to the base, the first lower channel member including a first lower channel.

2. The firebox of claim 1, wherein the back and the sides include a plurality of fins extending outward from the back and inward from the back towards the opening.

3. The firebox of claim 2, wherein the back, the sides and the fins are a single extrusion.

4. The firebox of claim 2, wherein the back includes a right side section, a left side section and a middle section.

5. The firebox of claim 4, further comprising a plurality of risers, a plurality of flanges, a plurality of upper channel members and a plurality of lower channel members, the upper channel of a selected upper channel member and the lower channel of a selected lower channel member aligned with a selected pair of flanges or a selected pair of risers.

6. The firebox of claim 5, wherein the sides each further comprise a second flange, which is parallel to the back, sits on the second riser and extends outward from the back; and a third riser, wherein the second flange and the third riser extend above the upper end of the back and below the lower end of the back.

7. A firebox assembly for a gas fireplace, the firebox assembly comprising:

a firebox, the firebox including: a back which includes at least one combustion fan aperture, an upper end and a lower end and a length therebetween; a pair of sides, each side including an upper end, a lower end, a first riser which has an inner section and an outer section, the inner section attached to the back, a first flange, which is parallel to the back and extends outward from the back, and a second riser, wherein the outer section of the first riser, the first flange and the second riser extend above the upper end of the back and below the lower end of the back; a top which is attached to the inner section of the first risers and to the back at the upper end; a base which is attached to the inner section of the first risers and to the back above the combustion fan aperture, to define an opening; a first glass upper channel member attached to the upper end of each side at the first risers and the first flanges, the first glass upper channel member including a first glass upper channel including a channel back, a channel top and a channel front, the channel back and the channel front defining a mouth, the channel back angled from the mouth towards the back to define an angled channel, the mouth disposed in front of the first flange; and a first lower channel member attached to the base, the first lower channel member including a first lower channel;

an innermost glass pane mounted over the opening and seated on the first flanges, the top and the base, the innermost glass pane, top, base, sides and back defining a combustion chamber;

a frame mounted on the innermost glass pane and seated above the first flanges, the top and the base to provide an airtight seal;

and a second glass pane releasably mounted in the first glass upper channel and the first lower channel and seated on the second risers.

8. The firebox assembly of claim 7, wherein the back and the sides include a plurality of fins extending outward from the back and inward from the back into the combustion chamber.

9. The firebox assembly of claim 8, wherein the back, the sides and the fins are a single extrusion.

10. The firebox assembly of claim 7, wherein the back includes a right side section, a left side section and a middle section.

11. The firebox assembly of claim 10, further comprising a plurality of risers and a plurality of flanges on each side, a plurality of panes of glass, a plurality of upper channel members and a plurality of lower channel members, each pane of glass seated on a selected flange or a selected riser and releasably retained by the upper channel of a selected upper channel member and the lower channel of a selected lower channel member, the upper channel of the selected upper channel member and the lower channel of the selected lower channel member aligned with the selected flange or the selected riser.

12. The firebox assembly of claim 11 further comprising: a second flange on each side, which are parallel to the back, are attached to the second riser and extend outward from the back; a third riser on each side, wherein the second flanges and the third risers extend above the upper end of the back and below the lower end of the back; a second upper channel member attached to the sides and located above the first glass upper channel member, the second upper channel member including a second upper channel which includes a channel back, a channel top and a channel front, the channel back and the channel front defining a mouth, the channel back angled from the mouth towards the back, the mouth disposed in front of the second flanges and the mouth of the middle glass upper channel member; a second lower channel member attached to the sides and located below the first lower channel member, the second lower channel member including a second lower channel which is disposed in front of the first lower channel; and a third glass pane releasably mounted in the second upper channel and the second lower channel and seated on the third risers.

13. The firebox assembly of claim 12, further comprising an airbox assembly, the airbox assembly including a top, a bottom, sides and a face, the top, the bottom and the sides attached to the back to define an airbox, the face including an exhaust port and an airbox connector aperture, which is aligned with the combustion fan aperture.

14. The firebox assembly of claim 13, wherein the airbox assembly includes an airbox connector, the airbox connector extending between and attached to the airbox face and the back of the firebox for fluid communication between an ambient environment and the combustion fan aperture.

15. A combination for use in constructing a gas fireplace, the combination comprising:

a firebox assembly comprising: a firebox, the firebox including a back which includes at least one combustion fan aperture, an upper end and a lower end and a length therebetween; a pair of sides, each side including an upper end, a lower end, a first riser which has an inner section and an outer section, the inner section attached to the back, a first flange, which is parallel to the back and extends outward from the back, and a second riser, wherein the outer section of the first riser, the first flange and the second riser extend above the upper end of the back and below the lower end of the back; a top which is attached to the inner section of the first risers and to the back at the upper end; a base which is attached to the inner section of the first risers and to the back above the combustion fan aperture, to define an opening; a first glass upper channel member attached to the upper end of each side at the first risers and the first flanges, the first glass upper channel member including a first glass upper channel including a channel back, a channel top and a channel front, the channel back and the channel front defining a mouth, the channel back angled from the mouth towards the back to define an angled channel, the mouth disposed in front of the first flange; and a first lower channel member attached to the base, the first lower channel member including a first lower channel;

an innermost glass pane mounted over the opening and seated on the first flanges, the top and the base;

a frame mounted on the innermost glass pane and seated above the first flanges, the top and the base to provide an airtight seal;

and a second glass pane releasably mounted in the first glass upper channel and the first lower channel and seated on the second risers;

an outer case comprising: an outer case back including an upper end and a lower end; a pair of sides, each side including an upper end and a lower end; an outer case bottom attached to the outer case back at the lower end and to the sides at the lower end; an outer case top attached to the outer case back at the upper end and to the sides at the upper end, the outer case top including a second upper channel including a channel back, a channel top and a channel front, the channel back and the channel front defining a mouth, the channel back angled from the mouth towards the back, the mouth disposed in front of the second pane of glass;

and a third pane of glass releasably mounted in the second upper channel of the outer case and the second lower channel of the firebox assembly.

16. A firebox assembly for a gas fireplace, the firebox assembly comprising:

a firebox, the firebox including: a back which includes at least one combustion fan aperture, an upper end and a lower end and a length therebetween; a pair of sides, each side including an upper end, a lower end, a riser which has an inner section and an outer section, the inner section attached to the back, a flange, which is parallel to the back and extends outward from the back; a top which is attached to the inner section of the risers and to the back at the upper end; a base which is attached to the inner section of the risers and to the back above the combustion fan aperture, to define an opening; a first glass upper channel member attached to the upper end of each side at the first risers and the first flanges, the first glass upper channel member including a first glass upper channel including a channel back, a channel top and a channel front, the channel back and the channel front defining a mouth, the channel back angled from the mouth towards the back to define an angled channel, the mouth disposed in front of the first flange; and a first lower channel member attached to the base, the first lower channel member including a first lower channel;

and a glass pane mounted over the opening and seated on the flanges, the top and the base, the glass pane, top, base, sides and back defining a combustion chamber, wherein the back and the sides include a plurality of fins extending outward from the back and inward from the back into the combustion chamber.

17. The firebox assembly of claim 16, further comprising an airbox assembly, the airbox assembly including a top, a bottom, sides and a face, the top, the bottom and the sides attached to the back to define an airbox, the face including an exhaust port and an airbox connector aperture, which is aligned with the combustion fan aperture.

18. The firebox assembly of claim 17, wherein the airbox assembly includes an airbox connector, the airbox connector extending between and attached to the airbox face and the back of the firebox for fluid communication between an ambient environment and the combustion fan aperture.

19. The firebox assembly of claim 18, wherein the back, the sides and the fins are a single extrusion.

20. The firebox assembly of claim 18, wherein the back includes a right side section, a left side section and a middle section.

* * * * *